US008494409B2

(12) United States Patent
Kawai et al.

(10) Patent No.: US 8,494,409 B2
(45) Date of Patent: Jul. 23, 2013

(54) PROCESS CARTRIDGE AND IMAGE FORMING APPARATUS

(75) Inventors: Tachio Kawai, Odawara (JP); Osamu Anan, Susono (JP); Yasunori Toriyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 310 days.

(21) Appl. No.: 13/042,841

(22) Filed: Mar. 8, 2011

(65) Prior Publication Data

US 2011/0229196 A1 Sep. 22, 2011

(30) Foreign Application Priority Data

Mar. 16, 2010 (JP) ..... 2010-059088
Mar. 3, 2011 (JP) ..... 2011-046024

(51) Int. Cl.
*G03G 21/16* (2006.01)

(52) U.S. Cl.
USPC ..... 399/111; 399/176

(58) Field of Classification Search
USPC ..... 399/111, 174, 175, 176
See application file for complete search history.

(56) References Cited

U.S. PATENT DOCUMENTS 5,903,803 A 5/1999 Kawai et al.
6,055,406 A 4/2000 Kawai et al.
6,064,841 A * 5/2000 Matsuzaki et al. ..... 399/90
6,115,567 A 9/2000 Kawai et al.
6,128,454 A 10/2000 Kawai et al.
6,163,665 A 12/2000 Watanabe et al.
6,175,706 B1 1/2001 Watanabe et al.
6,226,478 B1 5/2001 Watanabe et al.
6,240,266 B1 5/2001 Watanabe et al.
6,336,018 B1 1/2002 Kawai et al.
6,349,188 B1 2/2002 Kawai et al.
6,381,430 B1 4/2002 Yokomori et al.
6,385,416 B1 * 5/2002 Horikawa et al. ..... 399/111
6,463,232 B1 10/2002 Kawai et al.

(Continued)

FOREIGN PATENT DOCUMENTS

CN 1940744 4/2007
CN 101592910 12/2009

(Continued)

OTHER PUBLICATIONS

Office Action in Chinese Patent Application No. 20110062787.0, mailed Aug. 31, 2012 (with English translation).

*Primary Examiner* — Hoang Ngo
(74) *Attorney, Agent, or Firm* — Fitzpatrick, Cella, Harper & Scinto

(57) ABSTRACT

A process cartridge includes a drum; a rotatable roller including a first shaft end portion and a second shaft end portion; a bearing member for rotatably supporting ends of a shaft of the rotatable roller; an urging member for urging the rotatable roller via the bearing member in a drum contact direction; a cartridge frame for rotatably supporting the drum and for movably holding the rotatable roller via the bearing member; a movable guide member movable in an axial direction of the shaft of the rotatable roller and including a first contact portion; and a fixed guide member including a second contact portion. At least one of the first contact portion and the first shaft end portion has an inclined surface inclined with respect to the axial direction of the rotatable roller, and at least one of the second contact portion and the second shaft end portion has an inclined surface inclined with respect to the axial direction of the rotatable roller.

18 Claims, 8 Drawing Sheets

U.S. PATENT DOCUMENTS

| | | | |
|---|---|---|---|
| 6,480,687 | B1 | 11/2002 | Kawai et al. |
| 6,496,667 | B2 | 12/2002 | Shiratori et al. |
| 6,501,926 | B1 | 12/2002 | Watanabe et al. |
| 6,501,927 | B1 | 12/2002 | Watanabe et al. |
| 6,560,422 | B2 | 5/2003 | Kanno et al. |
| 6,735,403 | B2 | 5/2004 | Kanno et al. |
| 6,738,588 | B2 | 5/2004 | Yokomori et al. |
| 6,947,686 | B2 | 9/2005 | Kawai et al. |
| 6,968,142 | B2 | 11/2005 | Arimitsu et al. |
| 7,016,626 | B2 | 3/2006 | Yokomori et al. |
| 7,027,754 | B2 | 4/2006 | Harada et al. |
| 7,046,942 | B2 | 5/2006 | Arimitsu et al. |
| 7,072,603 | B2 | 7/2006 | Tsuzuki et al. |
| 7,085,516 | B2 | 8/2006 | Kawai et al. |
| 7,099,607 | B2 | 8/2006 | Suzuki et al. |
| 7,130,560 | B2 | 10/2006 | Kawai et al. |
| 7,233,752 | B2 | 6/2007 | Harada et al. |
| 7,257,353 | B2 | 8/2007 | Kawai et al. |
| 7,310,489 | B2 | 12/2007 | Kawai |
| 7,366,439 | B2 | 4/2008 | Anan et al. |
| 7,457,569 | B2 | 11/2008 | Kawai |
| 7,555,249 | B2 | 6/2009 | Kawai |
| 7,720,412 | B2 | 5/2010 | Anan et al. |
| 7,792,464 | B2 | 9/2010 | Okabe et al. |
| 7,848,684 | B2 | 12/2010 | Kawai |
| 8,160,477 | B2 | 4/2012 | Anan et al. |
| 8,238,785 | B2 | 8/2012 | Kawai |
| 2007/0077093 | A1 | 4/2007 | Okabe et al. |
| 2007/0092291 | A1 | 4/2007 | Suzuki et al. |
| 2009/0003875 | A1 | 1/2009 | Toba et al. |
| 2009/0290903 | A1 | 11/2009 | Horikawa et al. |
| 2009/0290904 | A1 | 11/2009 | Kawai et al. |
| 2009/0297212 | A1 | 12/2009 | Anan et al. |
| 2009/0297219 | A1 | 12/2009 | Yoshino et al. |
| 2010/0221039 | A1 | 9/2010 | Kawai et al. |
| 2011/0008074 | A1 | 1/2011 | Kawai |

FOREIGN PATENT DOCUMENTS

| | | |
|---|---|---|
| CN | 101592913 | 12/2009 |
| JP | 2-039169 | 2/1990 |
| JP | 6-316349 | 11/1994 |
| JP | 2007114523 | 5/2007 |

* cited by examiner

PROCESS CARTRIDGE AND IMAGE FORMING APPARATUS

FIELD OF THE INVENTION AND RELATED ART

The present invention relates to a process cartridge detachably mountable to a main assembly of an image forming apparatus and relates to the image forming apparatus in which the process cartridge is mounted.

Here, as the image forming apparatus, e.g., there is an electrophotographic image forming apparatus. The electrophotographic image forming apparatus forms an image on a recording material by using an electrophotographic image forming method and, e.g., includes an electrophotographic copying machine, an electrophotographic printer (LED printer, laser beam printer, etc.) a facsimile machine, a word processor, and so on.

Here, the recording material is an object on which the image is to be formed and, e.g., includes a recording sheet, an OHP sheet, etc.

Further, the process cartridge is prepared by integrally assembling at least one of a charging means, a developing means and a cleaning means, and an electrophotographic photosensitive drum into a cartridge, which is detachably mountable to the main assembly of the electrophotographic image forming apparatus. Thus, the process cartridge includes one prepared by integrally assembling the developing means, as a process means, and the electrophotographic photosensitive drum into a cartridge, which is detachably mountable to the main assembly of the electrophotographic image forming apparatus.

In the electrophotographic image forming apparatus, a charging device for uniformly charging the surface of the electrophotographic photosensitive drum (hereinafter referred to as a photosensitive drum) has been conventionally provided. This charging device is generally of a non-contact type using corona discharge and of a contact type using a charging member such as a charging roller. In recent years, for the purpose of preventing an occurrence of ozone, the latter contact type has been generally used. On the other hand, the charging device of the contact type causes, when the charging member was left standing in a state in which it was kept contact with the photosensitive drum for a long time, permanent deformation at a portion contacting the photosensitive drum to result in a change in charging power, so that image defect such as density non-uniformity occurred in some cases. For that reason, a constitution in which the charging member is not left standing in the state in which it is kept contact with the photosensitive drum for a long time may desirably be employed.

Further, in the conventional electrophotographic image forming apparatus, a process cartridge type in which the photosensitive drum and the process means acting on the photosensitive drum are integrally assembled into a cartridge which is detachably mountable to the apparatus main assembly has been employed. Also in such a process cartridge, the above-described charging device of the contact type is used in some cases. On the other hand, by vibration or the like during transportation of the process cartridge, the photosensitive drum and the charging member rub against each other to leave hysteresis as charging memory, so that the image defect such as the density non-uniformity was caused to occur in some cases. For that reason, a constitution in which a contact pressure between the charging member and the photosensitive drum is alleviated during transportation is desired.

As a contact and separation mechanism between the photosensitive drum and the charging roller in such a process cartridge, the following constitutions have been known. Japanese Laid-Open Patent Application (JP-A) Hei 2-39169 discloses a constitution in which a spacer member is sandwiched between the photosensitive drum and the charging member particularly in a region (a non-image forming region) outside a region (image forming region) in which an image is written, and the photosensitive drum and the charging member are held in a separated (spaced) state during unused condition (particularly during the transportation). JP-A Hei 6-316349 discloses a constitution in which the photosensitive drum and a transfer roller (which is not an example of the charging member) are moved toward and away from each other by drive of a solenoid. U.S. Pat. No. 7,072,603 discloses a constitution in which a supporting member is provided at both end portions of the charging roller and when the supporting member is manually moved, a contact and separation state of the charging roller relative to the photosensitive drum is adjusted.

However, in the constitutions described in JP-A Hei 2-39169, JP-A Hei 6-316349 and U.S. Pat. No. 7,072,603, labor or a driving force for inserting the spacer by a human or a machine is required before the transportation of the electrophotographic image forming apparatus. Further, in the constitution described in JP-A Hei 6-316349, a driving force for driving the solenoid is required. Such labor and driving forces may desirably be reduced.

SUMMARY OF THE INVENTION

In view of the above circumstances, a principal object of the present invention is to provide a process cartridge capable of reducing labor or a driving force required for contact and separation of a charging member relative to an electrophotographic photosensitive drum.

Another object of the present invention is to provide an image forming apparatus including the process cartridge.

According to an aspect of the present invention, there is provided a process cartridge detachably mountable to a main assembly of an image forming apparatus, comprising:

an image bearing member capable of bearing a toner image;

a rotatable roller rotatable in contact with the image bearing member;

a bearing member for rotatably supporting ends of a shaft of the rotatable roller;

urging means for urging the rotatable roller via the bearing member in a direction in which the rotatable roller is contacted to the image bearing member;

a cartridge frame for rotatably supporting the image bearing member and for movably holding the rotatable roller via the bearing member in a contact and separation direction in which the rotatable roller is contacted to and separated from the image bearing member;

a movable guide member which is supported, by the cartridge frame, movably in an axial direction of the shaft of the rotatable roller and which is provided at one end side of the rotatable roller, the movable guide member including a first contact portion at an opposing position in which it opposes a first shaft end portion of the rotatable roller; and a fixed guide member which is fixed to the cartridge frame and which is provided at the other end side of the rotatable roller, the fixed guide member including a second contact portion at an opposing position in which it opposes a second shaft end portion of the rotatable roller, wherein at least one of the first contact portion and the first shaft end portion has an inclined surface inclined with respect to the axial direction of the rotatable roller, and at least one of the second contact portion and the second shaft end portion has an inclined surface inclined with respect to the axial direction of the rotatable roller.

According to another aspect of the present invention, there is provided an image forming apparatus including a main assembly to which a process cartridge is detachably mountable, comprising:

a mounting portion for mounting and demounting the process cartridge; and the process cartridge, comprising:

an image bearing member capable of bearing a toner image;

a rotatable roller rotatable in contact with the image bearing member;

a bearing member for rotatably supporting ends of a shaft of the rotatable roller;

urging means for urging the rotatable roller via the bearing member in a direction in which the rotatable roller is contacted to the image bearing member;

a cartridge frame for rotatably supporting the image bearing member and for movably holding the rotatable roller via the bearing member in a contact and separation direction in which the rotatable roller is contacted to and separated from the image bearing member;

a movable guide member which is supported, by the cartridge frame, movably in an axial direction of the shaft of the rotatable roller and which is provided at one end side of the rotatable roller, the movable guide member including a first contact portion at an opposing position in which it opposes a first shaft end portion of the rotatable roller; and a fixed guide member which is fixed to the cartridge frame and which is provided at the other end side of the rotatable roller, the fixed guide member including a second contact portion at an opposing position in which it opposes a second shaft end portion of the rotatable roller, wherein at least one of the first contact portion and the first shaft end portion has an inclined surface inclined toward the axial direction of the rotatable roller, and at least one of the second contact portion and the second shaft end portion has an inclined surface inclined toward the axial direction of the rotatable roller.

These and other objects, features and advantages of the present invention will become more apparent upon a consideration of the following description of the preferred embodiments of the present invention taken in conjunction with the accompanying drawings.

Figure 4:
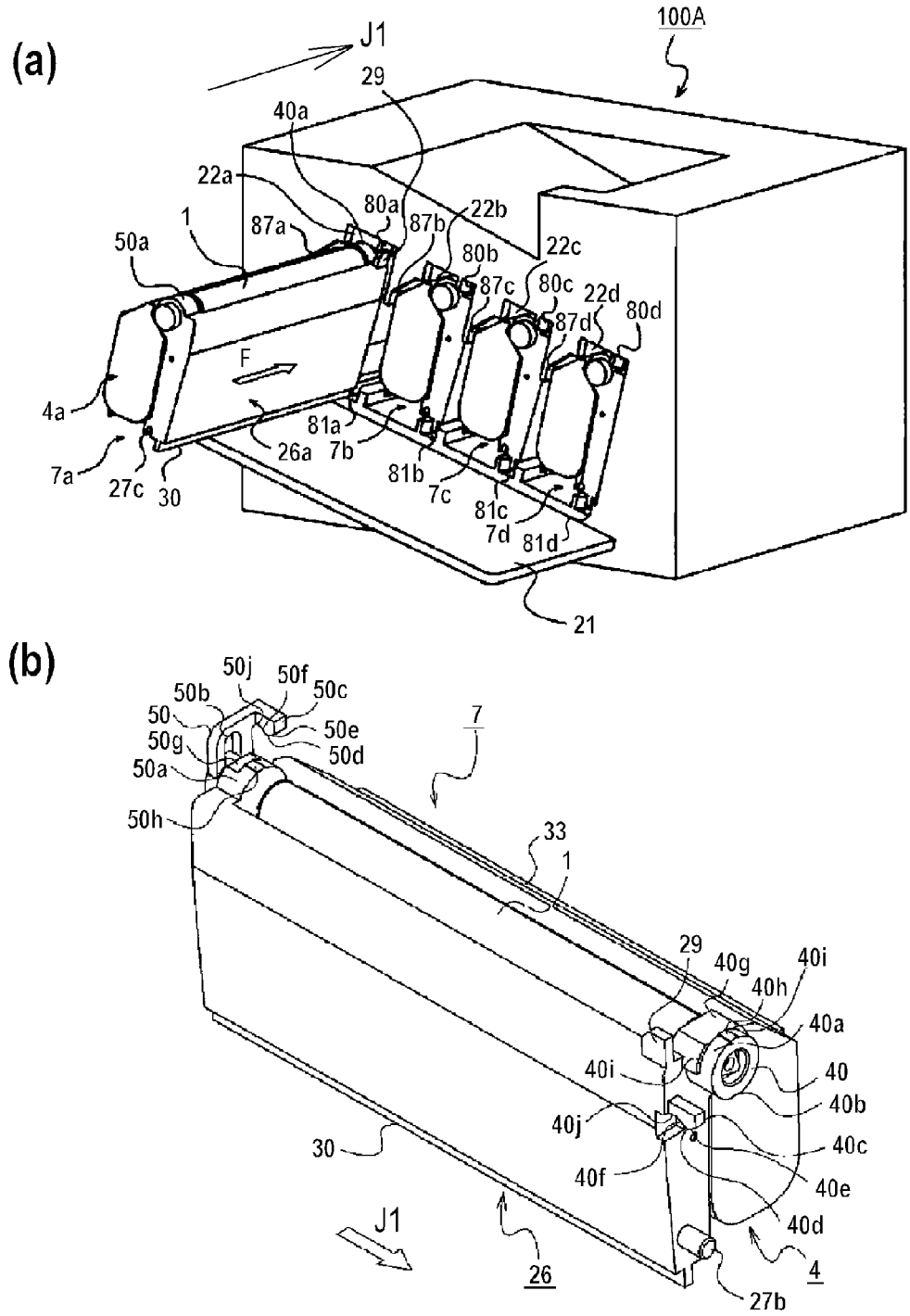

Parts (a) and (b) of FIG. 4 are perspective views showing a positional relation among a cover, the apparatus main assembly and the cartridge.

Figure 5:
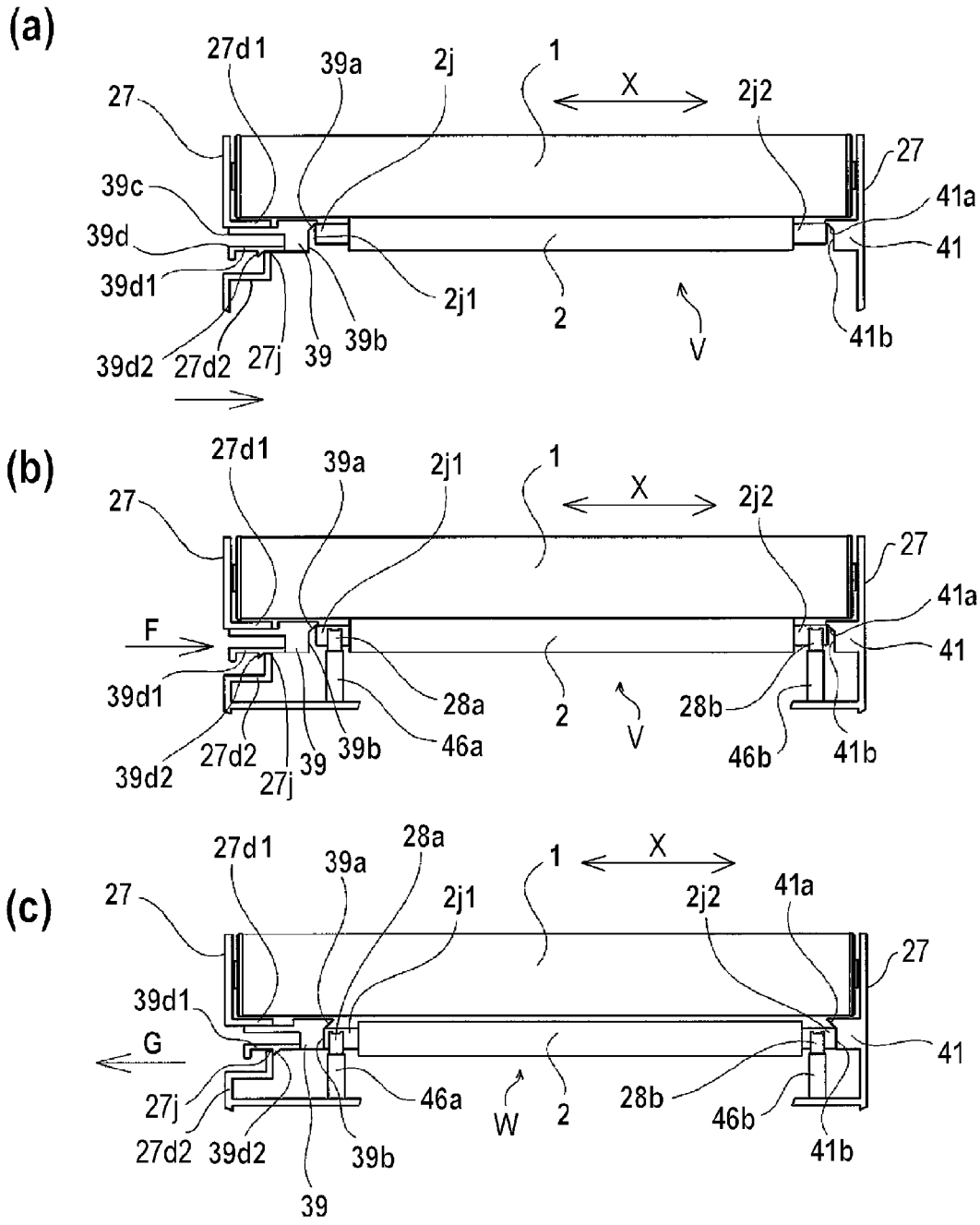

Parts (a), (b) and (c) of FIG. 5 are side views showing a position relation among a movable guide member, a fixed guide member, a charging roller and a photosensitive drum.

Figure 6:
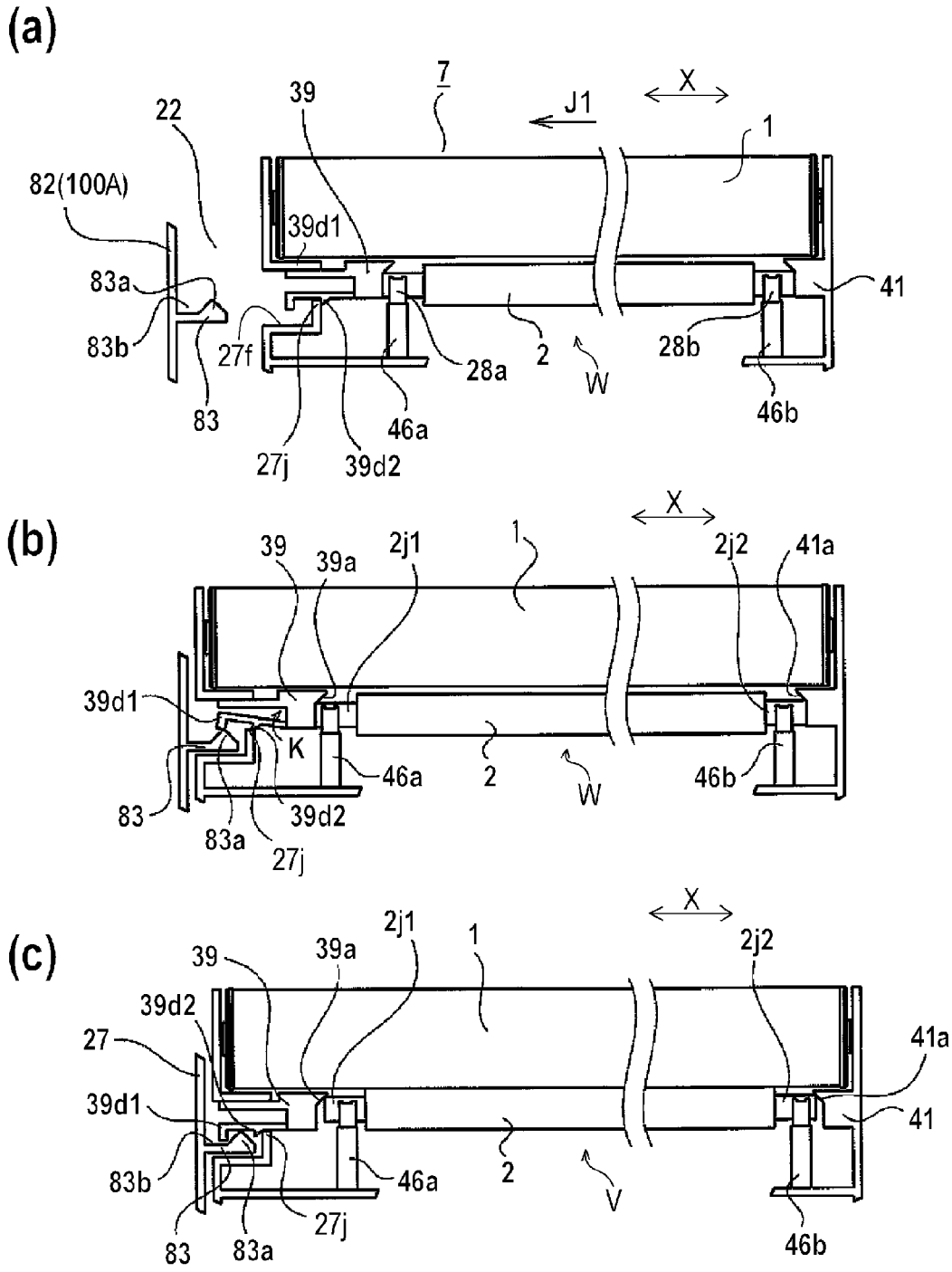

Parts (a), (b) and (c) of FIG. 6 are side views for illustrating a state in which the charging roller is separated (spaced) from the photosensitive drum.

Figure 7:
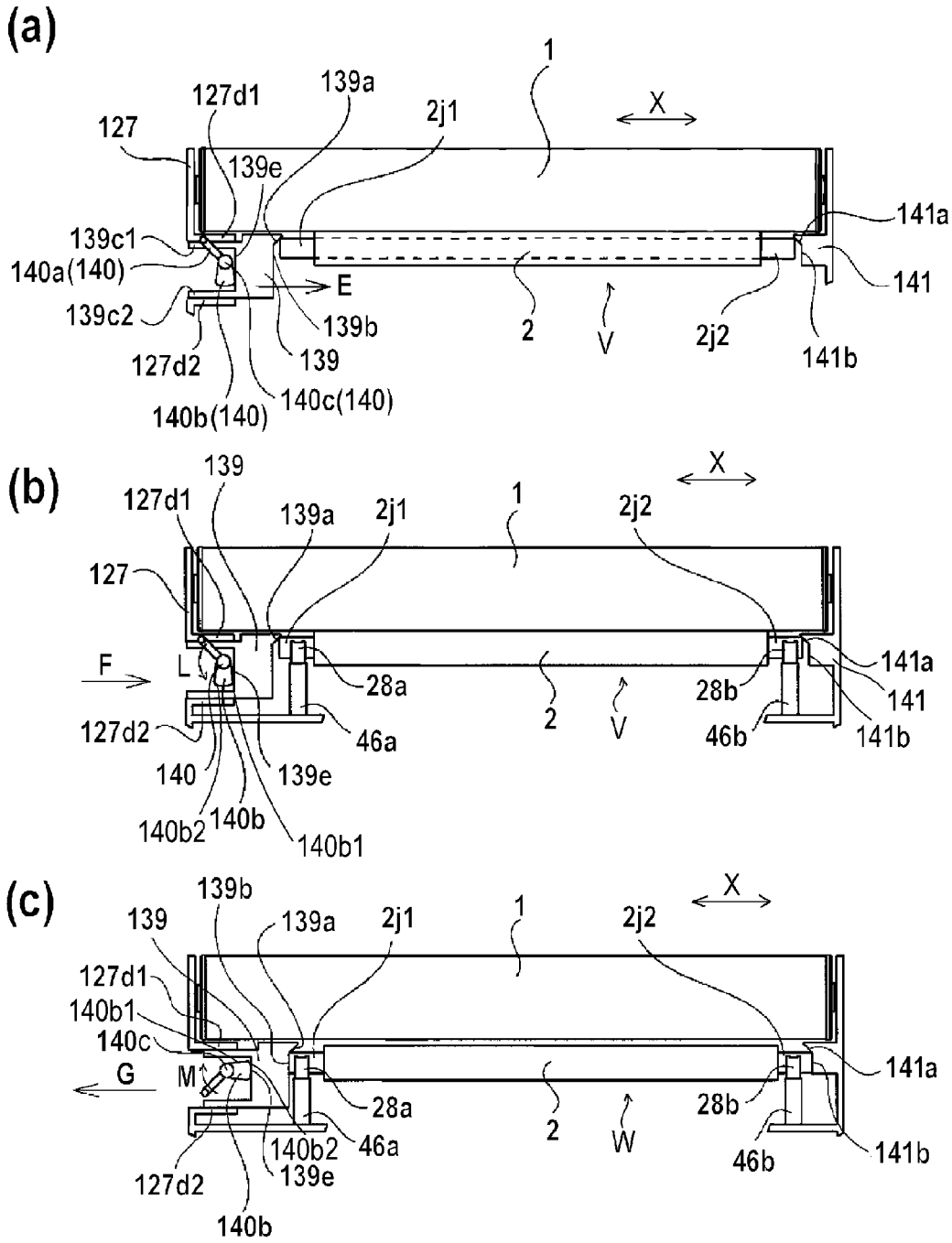

Parts (a), (b) and (c) of FIG. 7 are side views showing a positional relation among a movable guide member, a fixed guide member, a charging roller and a photosensitive drum which are included in a process cartridge and an apparatus main assembly in Embodiment 2.

Figure 8:
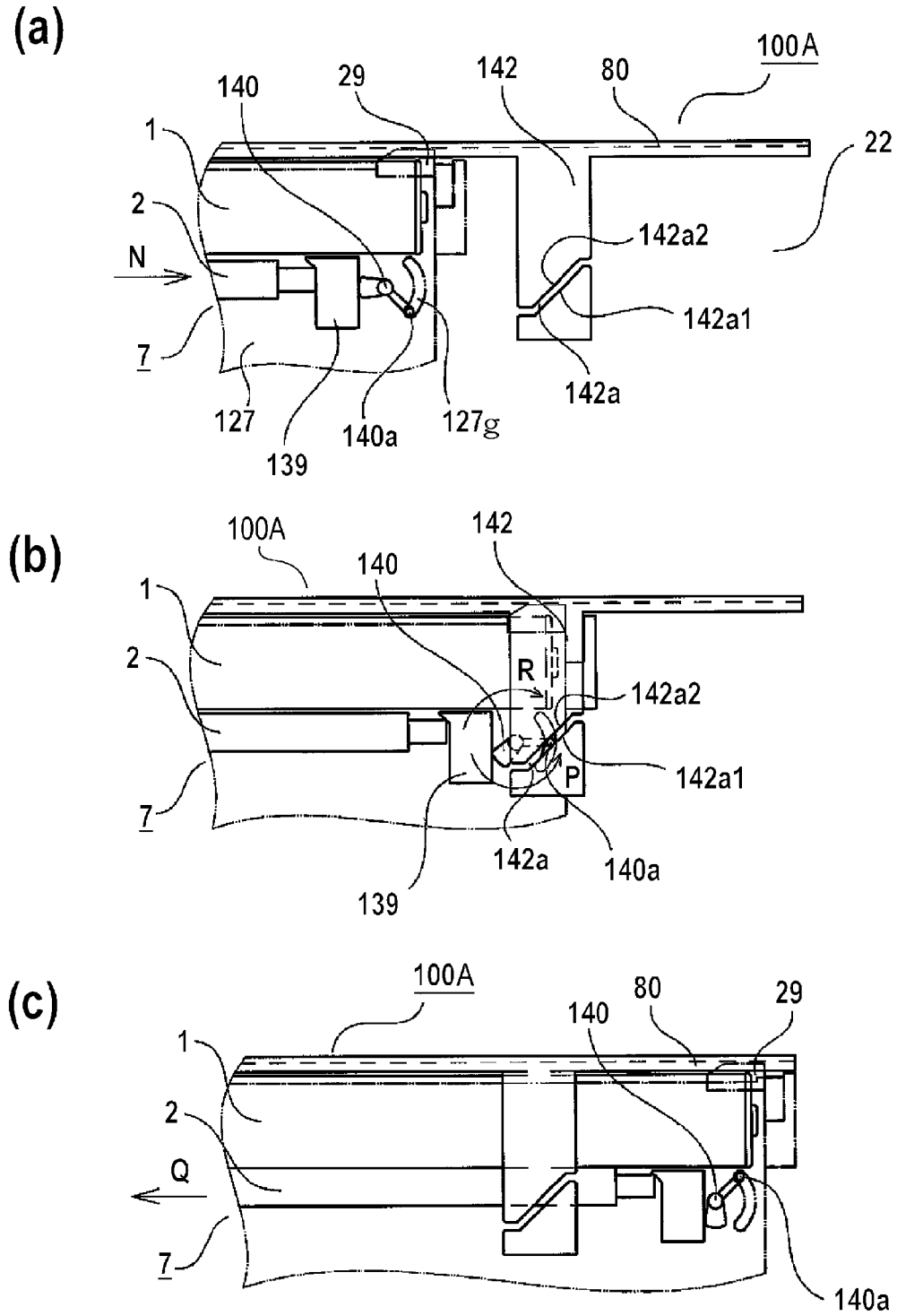

Parts (a), (b) and (c) of FIG. 8 are enlarged side views showing constitutions of the charging roller, the movable guide member, a locking mechanism and a contact and separation control member.

DESCRIPTION OF THE PREFERRED EMBODIMENTS

Hereinbelow, embodiments for carrying out the present invention will be exemplarily and specifically described with reference to the drawings. However, dimensions, materials, shapes, relative arrangements and the like of constituent elements described in the following embodiments are appropriately changed depending on constitutions or various conditions of devices (apparatuses) to which the present invention is applied and thus the scope of the present invention is not limited thereto unless otherwise specified.

Embodiment 1

Figure 1:
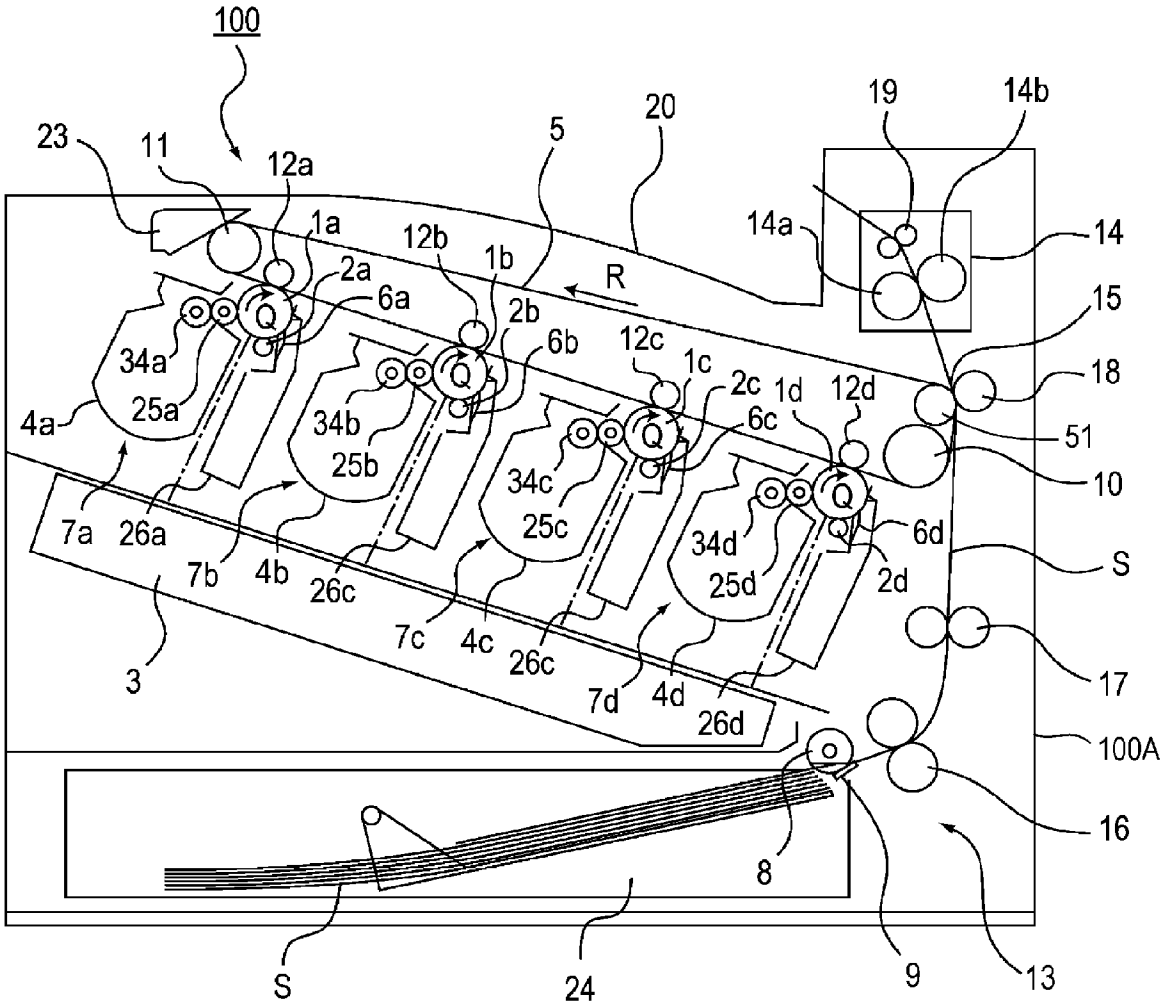
FIG. 1 is a sectional view showing a structure of an image forming apparatus including a process cartridge according to Embodiment 1 of the present invention.

FIG. 1 is a sectional view showing a structure of an image forming apparatus 100 including a process cartridge according to Embodiment 1 of the present invention. The image forming apparatus 100 utilizes an electrophotographic image forming process. As shown in FIG. 1, the image forming apparatus 100 includes an image forming apparatus main assembly (hereinafter simply referred to as an "apparatus main assembly") 100A in which image forming portions for forming images are provided. Each of the image forming portions includes an electrophotographic photosensitive drum which is an image bearing member (hereinafter simply referred to as a "photosensitive drum") 1, a primary transfer roller 12 which is a transfer device, and the like. At least the photosensitive drum 1 is included in a cartridge 7 and is configured to be assembled, as the cartridge 7, into the apparatus main assembly 100. Incidentally, in the case where a plurality of members are represented with respect to the photosensitive drum 1, a charging roller 2 and a developing unit 4, the members are represented by associated reference numerals provided with suffixes, a, b, c and d in the following description in some instances. Further, in the case where a plurality of members are represented with respected to a cleaning member 6, the cartridge 7, a mounting portion 22, a developing roller 25, a photosensitive member unit 26 and a supplying roller 34, the members are represented by associated reference numerals provided with the suffixes a, b, c, and d in some instances.

Figure 3:
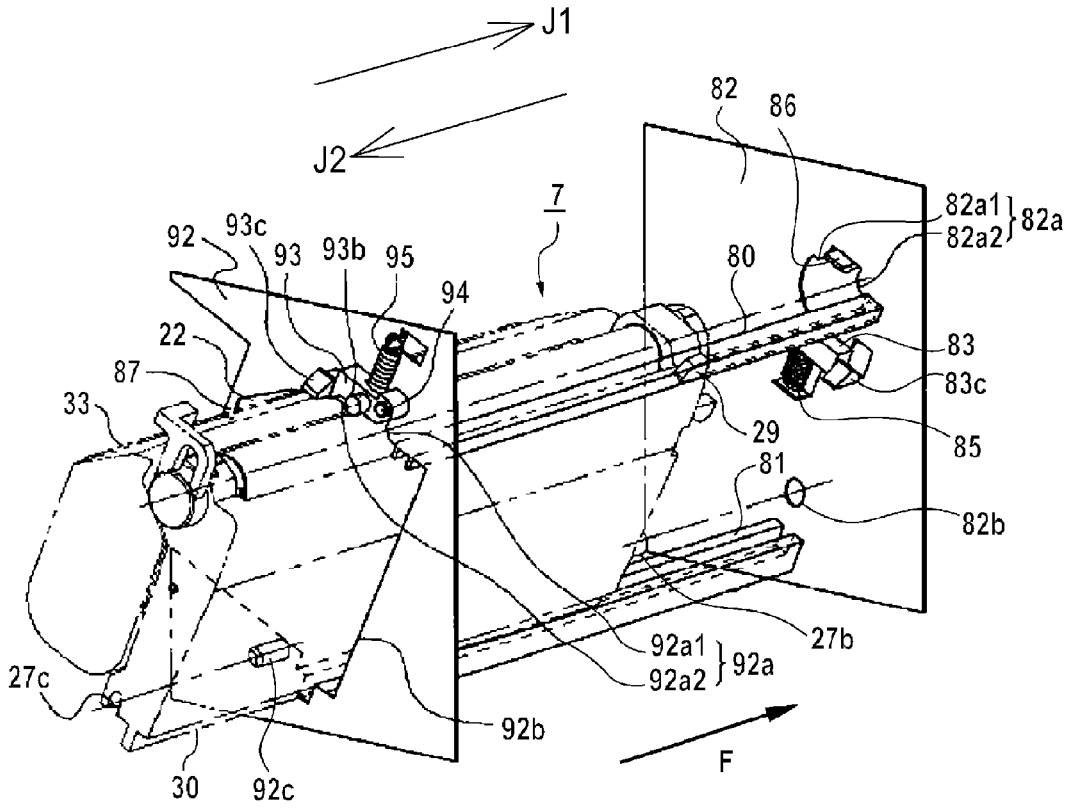
FIG. 3 is a schematic perspective view showing a guide constitution and positioning constitution of an apparatus main assembly.

The image forming apparatus 100 includes four mounting portions 22 (22*a*-22*d*) (FIG. 3 and (a) of FIG. 4), as mounting means for four cartridges, which are juxtaposed and inclined with respect to a horizontal direction. The cartridges 7 (7*a*-7*d*), detachably mountable to the apparatus main assembly 100A as the electrophotographic image forming apparatus main assembly, which are mounted in the mounting portions 22, are provided with electrophotographic photosensitive drums 1 (1*a*-1*d*) each as a single image bearing member, respectively.

The photosensitive drum) 1 is rotationally driven in a direction indicated by an arrow Q by a driving member (unshown).

Around each of the photosensitive drums 1, the following process means acting on the photosensitive drum 1 are disposed along its rotational direction in the following order. That is, the cleaning member 6 (6*a*-6*d*) for removing a developer remaining on the photosensitive drum 1 surface after transfer (hereinafter referred to as "toner t" is disposed. Next, the charging roller 2 (2*a*-2*d*) for uniformly charging the surface of the photosensitive drum 1 is disposed. The charging roller 2 as a charging means charges the photosensitive drum 1 in contact with the photosensitive drum 1. The developing unit 4 (4*a*-4*d*) for developing an electrostatic latent image with the toner t is disposed. Next, an intermediary transfer belt 5 onto which four color toner images on the photosensitive drums 1 are to be collectively transferred is disposed. Below the photosensitive member units 26 and the developing units 4, a scanner unit 3 is disposed. The scanner unit 3 forms the electrostatic latent images on the surface of the photosensitive drums 1 each located between the charging roller 2 (2*a*-2*d*) and the developing roller 25 (25*a*-25*d*) by irradiation with a laser beam on the basis of image information. Here, photosensitive drum 1, the cleaning member 6, the charge roller 2, and the developing unit 4 are integrally assembled into a cartridge and constitute the cartridge 7.

The intermediary transfer belt 5 is stretched around a driving roller 10, a tension roller 11 and a second transfer opposite roller 51. Inside the intermediary transfer belt 5, the primary transfer rollers 12 (12*a*-12*d*) are disposed oppositely to the photosensitive drums 1 (1*a*-1*d*). To the intermediary transfer belt 5, a transfer bias is applied by a bias applying means (unshown). The toner images formed on the surfaces of the photosensitive drums 1 are successively primary-transferred onto the intermediary transfer belt 5 by rotation of each photosensitive drum 1 in the direction indicated by the arrow Q, rotation of the intermediary transfer belt 5 in the direction indicated by an arrow R, and by application of a positive bias to each primary transfer roller 12. Then, the four color toner images in a superposed state on the intermediary transfer belt 5 are conveyed to the secondary transfer portion 15.

In synchronism with the image forming operation, a sheet S as a recording material is conveyed by a conveying means consisting of a sheet feeding device 13, a registration roller pair 17, etc. The sheet feeding device 13 includes a sheet feeding cassette 24 for accommodating the sheets S, a sheet feeding roller 8 for feeding the sheets S, and a sheet conveying roller pair 16 for conveying the fed sheets S. The sheet feeding cassette 24 can be pulled out of the apparatus main assembly 100A in the frontward direction in FIG. 1. The sheets S accommodated in the sheet feeding cassette 24 are press-contacted to the sheet feeding roller 8 and is separated one by one by a separation pad 9 (one-side friction sheet separating method), thus being conveyed.

Then, the sheet S conveyed from the sheet feeding device 13 is conveyed to the secondary transfer portion 15 by the registration roller pair 17. At the secondary transfer portion 15, the positive bias is applied to the secondary transfer roller 18. As a result, the four color toner images on the intermediary transfer belt 5 are secondary-transferred onto the conveyed sheet S.

A fixing portion 14 as a fixing means fixes the toner images on the sheet S by applying heat and pressure to the toner images formed on the sheet S. A fixing belt 14*a* is cylindrical and is guided by a belt guide member (unshown) to which a heat generating means, such as a heater is bonded. The fixing belt 14*a* and the pressing roller 14*b* form a fixing nip with a predetermined press-contact force. The sheet S on which the unfixed toner images conveyed from the image forming portions is heated and pressed in the fixing nip. As a result, the unfixed toner images on the sheet S are fixed on the sheet S. Thereafter, the sheet S on which the toner images are fixed is discharged on a sheet discharge tray 20 by a sheet discharge roller pair 19.

Figure 2:
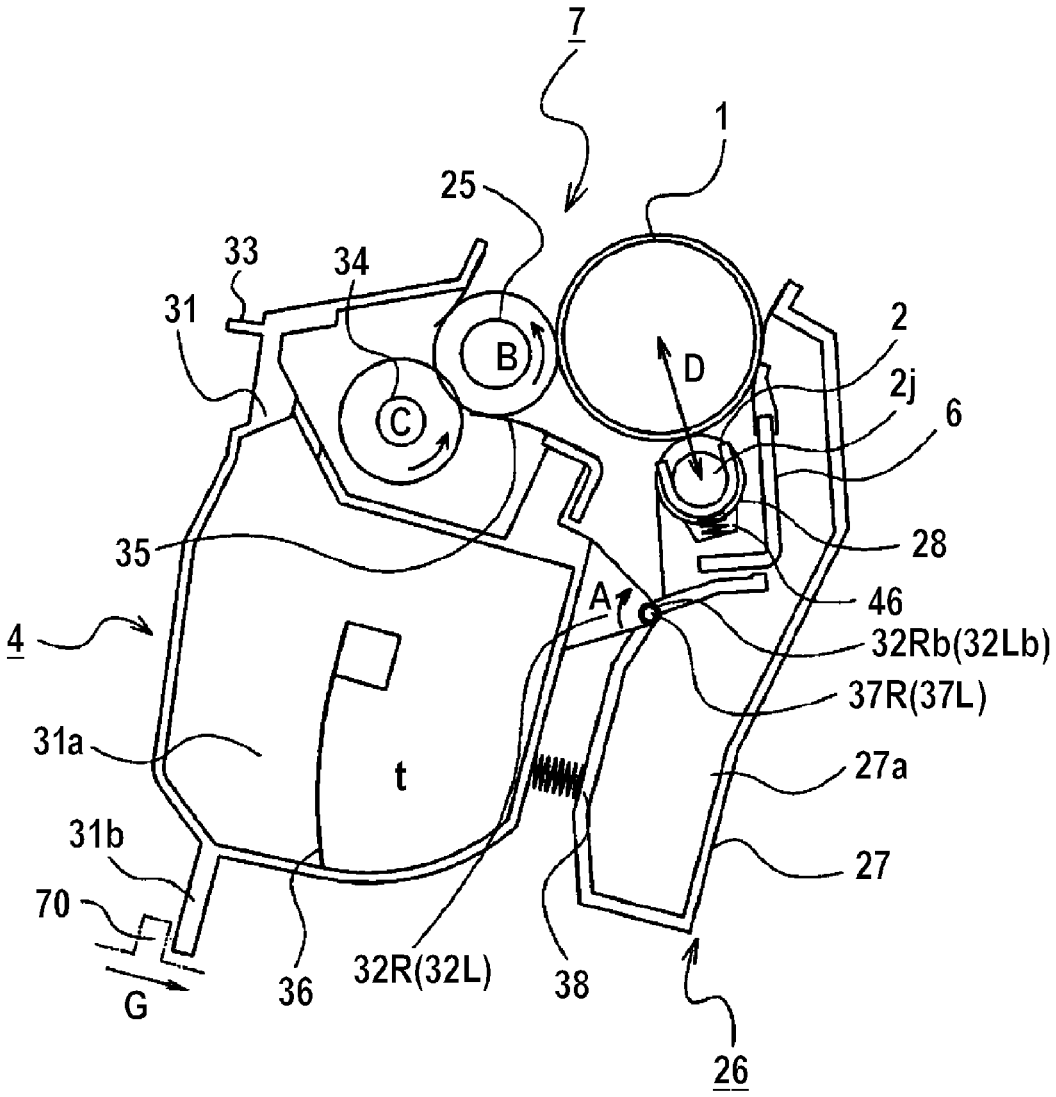
FIG. 2 is a sectional view of a cartridge.

The toner t remaining on the surface of the photosensitive drum 1 after the toner image transfer is removed by the cleaning member 6. The removed toner t is collected in a removed toner chamber 17*a* in the photosensitive member unit 26 (26*a*-26*d*) (FIG. 2). Further, the toner t remaining on the surface of the intermediary transfer belt 5 after the second transfer onto the sheet S is removed by a transfer belt cleaning device 23. The removed toner t is conveyed through a waste toner conveyance passage (unshown), and is collected in a waste toner collecting container (unshown) located in the rear end portion of the apparatus.

FIG. 2 is a sectional view of the cartridge 7. Incidentally, the cartridges 7*a*, 7*b*, 7*c*, and 7*d*, which contain yellow, magenta, cyan, and black toners t, respectively, have the same constitution. Each cartridge 7 is divided into the photosensitive member unit 26 and a developing unit 4. The photosensitive member unit 26 includes the photosensitive drum 1, the charge rolling 2 (charging means), and the cleaning member 6 (cleaning means). The developing unit 4 includes the developing roller 25 (developing means). The photosensitive member unit 26 includes a cleaning device frame as a cartridge frame (hereinafter referred to as a frame 27). The frame 27 rotatably supports the photosensitive drum 1 via bearings described later, and holds the charging roller 2 movably in a contact and separation direction in which the charging roller 2 is contacted to and away from the photosensitive drum 1 via bearing members 28. Then, the photosensitive drum 1 is rotationally driven correspondingly to the image forming operation by transmitting the driving force from a motor (unshown) to the photosensitive member unit 26. The charge roller 2 and the cleaning member 6 are disposed on the peripheral surface of the photosensitive drum 1 as described previously. The residual toner removed from the surface of the photosensitive drum 1 by the cleaning member 6 falls into the removed toner chamber 27*a*. To the frame 27, charging roller bearing members (hereinafter referred to as bearing members) 28 are attached so as to be movable in the direction indicated by an arrow D, which passes through the centers of the charging roller 2 and the photosensitive drum 1. Specifically, this constitution is as follows. That is, the bearing members 28 rotatably support both end portions of a shaft portion 2*j* of the charging roller 2. Further, the bearing members 28 are in a state in which they are urged toward the photosensitive drum 1 by charging roller urging members as urging means (hereinafter referred to as urging members 46) and therefore the urging members 46 urge the charging roller 2 toward the photosensitive drum 1 via the bearing members 28.

The developing unit 4 includes the developing roller 25 rotating in contact with the photosensitive drum 1 in the direction indicated by an arrow B, and includes a developing device frame 31. The developing roller 25 is rotatably supported by the developing device frame 31 via bearing members 32 (32R, 32L) attached to both sides of the developing device frame 31 with respect to a longitudinal direction indicated by an arrow X in FIG. 5 (direction from a back surface to a front surface of the drawing sheet of FIG. 2). On the peripheral surface of the developing roller 25, the supplying roller 34 rotatable in contact with the developing roller 25 in the direction indicated by an arrow C, and a developing blade 35 for regulating in thickness the toner layer on the developing roller 25. Further, to a toner containing portion 31*a* of the developing device frame 31, a toner conveying member 36 for conveying the contained toner t to the supplying roller 34 while stirring the toner t is provided.

The developing unit 4 is rotatably connected to the photosensitive member unit 26 about shafts 37R and 37L engaged with holes 32Rb and 32Lb provided in the shaft supporting members 32R and 32L. The developing unit 20 is urged by an urging spring 38. For that reason, during the image formation using the cartridge 7, the developing unit 4 rotates about the shafts 37 in the direction indicated by an arrow A, so that the developing roller 25 contacts the photosensitive drum 1.

FIG. 3 is a schematic perspective view showing a guide constitution and positioning constitution of the apparatus main assembly 100A. As shown in FIG. 3, in the apparatus main assembly 100A, a side plate 82 is provided at a rear side in a mounting direction J1 and a side plate 92 is provided at a front side in a pulling-out direction J2. The side plate 92 is provided with the mounting portion 22 through which the cartridge 7 is to be detachably mounted. The mounting portion 22 is an opening through which the cartridge 7 is passed. The cartridge 7 is inserted into the apparatus main assembly 100A through the mounting portion 22.

Further, the side plate 82 is provided with two abutting portions 82*a* (82*a*1, 82*a*2) constituting a first main assembly-side positioning portion for permitting positioning of the cartridge 7 with respect to a direction perpendicular to the mounting direction J1 (movement direction).

Further, the side plate 92 is provided with an inserting hole (opening) 92*b* through which the cartridge 7 is to be inserted. Further, at an upper portion of the inserting hole 92*b*, two abutting portions 92*a* (92*a*1, 92*a*2) constituting a second main assembly-side positioning portion for permitting positioning of the cartridge 7 with respect to the direction perpendicular to the mounting direction J1.

Part (a) of FIG. 4 is a perspective view showing a positional relation among a cover 21, the apparatus main assembly 100A and the cartridges 7. As shown in (a) of FIG. 4, on the front side of the apparatus main assembly 100A, an openable cover 21 is provided. When a user opens the cover 21, the mounting portions 22 (22*a*-22*d*) for the four cartridges 7 (7*a*-7*d*) which are juxtaposed and inclined with respect to the horizontal direction are exposed. On an upper side and lower side of each mounting portion 22, an upper mounting guide 80 (80*a*-80*d*) as a first main assembly(-side) guide and a lower mounting guide 81 (81*a*-81*d*) as a second main assembly(-side) guide are provided, respectively. Each of the upper mounting guide 80 and the lower mounting guide 81 has a groove shape elongated from the front side to the rear side of the apparatus main assembly 100A along the mounting direction J1 of the cartridge 7 (FIG. 3). Further, on the upper side of each mounting portion 22, an auxiliary guide 87 (87*a*-87*d*) as a third main assembly(-side) guide is provided. The auxiliary guide 87 has a projection shape projected from the upper side toward the lower side of each mounting portion 22 (FIG. 3).

Part (b) of FIG. 4 is a perspective view showing a structure of the cartridge 7. As shown in (b) of FIG. 4, the cartridge 7 includes the photosensitive member unit 26, which includes an upper-side portion to be guided 29 which is projected upward at a position corresponding to the upper mounting guide 80 formed in the apparatus main assembly 100A and is guided by the upper mounting guide 80. This upper-side portion to be guided 29 is formed on the rear side in the mounting direction J1 of the cartridge 7 in the photosensitive member unit 26 (in a lower right direction in (b) of FIG. 4), and has a projection shape engageable with the groove shape of the upper mounting guide 80 in the apparatus main assembly 100.

On the other hand, the photosensitive member unit 26 includes a lower-side portion to be guided 30 which is projected downward at a position corresponding to the lower mounting guide 81 formed in the apparatus main assembly 100A and is guided by the lower mounting guide 81. This lower-side portion to be guided 30 is formed on a bottom surface of the cartridge 7 and extended from the front side to the rear side in the mounting direction J1 of the cartridge 7 in the photosensitive member unit 26, and has a projection shape engageable with the groove shape of the lower mounting guide 81 in the apparatus main assembly 100. Incidentally, the front side refers to an upper left direction in (b) of FIG. 4 and the rear side refers to the upper right direction in (b) of FIG. 4.

On the other hand, the cartridge 7 includes the developing unit 4, in which a lateral-side portion to be guided 33 which is projected laterally at a position corresponding to the auxiliary guide 87 formed in the apparatus main assembly 100A and is guided by the auxiliary guide 87 is provided. This lateral-side portion to be guided 33 extends along the mounting direction J1 of the cartridge 7 in the developing unit 4 and is projected in a direction perpendicular to an axial of the photosensitive drum 1. That is, the lateral-side portion to be guided 33 has a projection shape projected from a side wall of the developing unit 4 in a lateral direction. Further, the lateral-side portion to be guided 33 is set, at a mounting completion position of the cartridge 7, at a length in which movement prevention by the auxiliary guide 87 is released. For this reason, the lateral-side portion to be guided 33 and the auxiliary guide 87 are not contacted except when the mounting of the cartridge 7 is in progress.

Further, the photosensitive member unit 26 includes the photosensitive drum 1. Both ends of a shaft portion (not shown) of the photosensitive drum 1 are rotatably held by bearings 40 and 50 fixed to the frame 27. At an upper and outer surface portion of the bearing 40 (first bearing member for supporting one end side of the photosensitive drum 1 in the axial (shaft) direction of the photosensitive drum 1) on the rear side in the mounting direction J1 in which the cartridge 7 moves the inside of the apparatus main assembly 100A, a first portion to be positioned 40*a* is provided.

Then, the bearing 50 (second bearing member for supporting the other end side of the photosensitive drum 1 in the axial direction) on the front side in the mounting direction J1 in which the cartridge 7 moves the inside of the apparatus main assembly 100A will be described. At an upper and outer surface portion of the front-side bearing 50, with respect to a direction perpendicular to the movement direction, a second portion to be positioned 50*a* having an arcuate shape for positioning the front side of the cartridge 7 relative to the apparatus main assembly 100A is provided.

The user engages, when the upper mounts the cartridge 7 into the apparatus main assembly 100A, the upper-side portion to be guided 29 provided on the photosensitive member unit 26 with the upper mounting guide 80 of the apparatus main assembly 100A. Similarly, the user engages the lower-side portion to be guided 30 provided on the photosensitive member unit 26 with the lower mounting guide 81 of the apparatus main assembly 100A. Further, the lateral-side portion to be guided 33 provided on the developing unit 4 is prevented from moving an upward direction and the lateral direction by the auxiliary guide 87 provided in the apparatus main assembly 100A. Then, the user pushes in the cartridge 7 in the mounting direction J1.

When the cartridge 7 is inserted into a predetermined position, the first portion to be positioned 40*a* and the second portion to be positioned 50*a* on the front side and the rear side of the cartridge 7, respectively, are positioned to the apparatus main assembly 100A. Thus, the mounting of the cartridge 7 is completed. Also in this mounting completion state of the cartridge 7, the engagement state between the upper-side portion to be guided 29 and the upper mounting guide 80 and the engagement state between the lower-side portion to be guided 30 and the lower mounting guide 81 are kept as they are. On the other hand, the lateral-side portion to be guided 33 as a third portion to be guided is in a state in which it does not contact the auxiliary guide 87.

Incidentally, in order to prevent rotation when a driving force is inputted into the cartridge 7, the cartridge 7 is provided at the rear side, with a shaft 27*b* (FIG. 3) projected in the mounting direction J1 (cartridge movement direction) and is provided, at the front side, with a U-shaped hole 27*c* (FIG. 3). Further, during the positioning of the cartridge 7, the shaft 27*b* and the hole 27*c* are engaged with an elongated hole 82*b* (FIG. 3) and a shaft 92*c* (FIG. 3) of the apparatus main assembly 100A, respectively. As a result, the user can stably move the cartridge 7 into the apparatus main assembly 100A.

Part (a) of FIG. 5 is a side view showing a positional relation among a movable guide member 39, a fixed guide member 41, the charging roller 2 and the photosensitive drum 1. As shown in (a) of FIG. 5, on one end side of the frame 27 with respect to the longitudinal direction X, the movable guide member 39 supported movably along the longitudinal direction X by the frame 27 is provided. On the other end side of the frame 27 with respect to the longitudinal direction X, the fixed guide member 41 formed integrally with the frame 27 is provided.

That is, the movable guide member 39 is held movably in the axial direction (longitudinal direction X) of the charging roller 2 by the frame 27. This movable guide member 39 is disposed on one side of the charging roller 2 with respect to the axial direction and includes a contact portion 39*a* as a first contact portion at an opposing position in which the movable guide member 39 opposes a shaft end portion 2*j*1 as a first shaft end portion of the charging roller 2. On the other hand, the fixed guide member 41 is fixed to the frame 27. This fixed guide member 41 is disposed on the other end side of the charging roller 2 with respect to the axial direction and includes a contact portion 41*a* as a second contact portion at an opposing portion in which the fixed guide member 41 opposes a shaft end portion 2*j*2 as a second shaft end portion of the charging roller 2. When the movable guide member 39 is moved to the charging roller 2, the case where the contact between the shaft end portion 2*j*2 and the contact portion 41*a* and the contact between the shaft end portion 2*j*1 and the contact portion 39*a* is assumed. In this case, the charging roller 2 is separated from the photosensitive drum 1 against an urging force of the urging member 46 ((b) and (c) of FIG. 5) while being moved in the axial direction.

The movable guide member 39 includes the contact portion 39*a*, a preventing portion 39*b*, a portion to be guided 39*c* and a locking portion 39*d*. On the other hand, the frame 27 includes guide portions 27*d*1 and 27*d*2 with which the portion to be guided 39*c* and the locking portion 39*d* of the movable guide member 39 are to be engaged, respectively. Further, the portion to be guided 39*c* is guided by the guide portion 27*d*1, and the locking portion 39*d* is guided by the guide portion 27*d*2. The movable guide member 39 is supported movably in the longitudinal direction X of the frame 27.

The contact portion 39*a* is disposed in a state in which a gap in a predetermined dimension is provided between itself and the photosensitive drum 1. This gap is ensured and even when the movable guide member 39 is moved, the movable guide member 39 is not contacted to the photosensitive drum 1 and thus the surface of the photosensitive drum 1 is not damaged. Further, the contact portion 39*a* is disposed at the opposing portion in which the movable guide member 39 opposes the shaft end portion 2*j*1 of a shaft portion 2*j* of the charging roller 2. The contact portion 39*a* is formed in a wedge shape inclined with respect to the longitudinal direction X. The contact portion 39*a* is formed by an inclined (conical or frusto-conical) surface which approaches the photosensitive drum 1 as it moves toward the charging roller 2. This inclined surface is inclined with respect to the axial direction of the charging roller 2. When the movable guide member 39 is moved to the charging roller 2, the contact portion 39*a* is moved (slid) while being contacted to the shaft end portion 2*j*1 in the axial direction. As a result, the charging roller 2 is moved in a separation (spacing) direction (perpendicular to the axial direction of the charging roller 2) in which the charging roller 2 is separated (spaced) from the photosensitive drum 1. When the movable guide member 39 is moved in a direction opposite from the direction toward the charging roller 2, the shaft end portion 2*j*1 is moved (slid) while being contacted to the contact portion 39*a* in the axial direction. As a result, the charging roller 2 is moved in a contact direction (perpendicular to the axial direction of the charging roller 2) in which the charging roller 2 is contacted to the photosensitive drum 1.

The locking portion 39*d* includes a lever 39*d*1 as a lever portion extending in the longitudinal direction X and includes a projection 39*d*2 which is formed at an intermediate position of the lever 39*d*1 with respect to the longitudinal direction X and is to be engaged with the frame 27. On the other hand, the guide portion 27*d*2 of the frame 27 includes a locking portion 27*j*, as a portion to be engaged, which is to be engaged with the projection 39*d*2. When the movable guide member 39 is moved and the projection 38*d*2 gets over the locking portion 27*j* and is then engaged with the locking portion 27*j*, the movement of the movable guide member 39 is prevented and the charging roller 2 is held at a separation (spacing) position W (second position) in which the charging roller 2 is separated (spaced) from the photosensitive drum 1.

The preventing portion 39*b* is formed by a flat surface substantially parallel to the surface of the shaft end portion 2*j*1. The preventing portion 39*b* is, in the case where the movable guide member 39 separates the charging roller 2 from the photosensitive drum 1 and is prevented from moving by the locking portion 39*d*, disposed at a position in which it opposes the shaft end portion 2*j*1. When the cartridge 7 is subjected to vibration and shock with respect to the longitudinal direction X by the transportation in the state in which the charging roller 2 is spaced from the photosensitive drum 1, by the contact between the preventing portion 39*b* and the shaft end portion 2*j*1, the movement of the charging roller 2 toward the movable guide member 39 is prevented.

Next, the fixed guide member 41 includes the contact portion 41*a* and a preventing portion 41*b* and is, similarly as in the case of the movable guide member 39, in a state in which a gap in a predetermined dimension is provided between itself and the photosensitive drum 1. This gap is ensured to prevent, the fixed guide member 41 from being contacted to the photosensitive drum 1 and thus the surface of the photosensitive drum 1 is not damaged. Further, the contact portion 41*a* is disposed at the opposing portion in which the fixed guide member 41 opposes the shaft end portion 2*j*2 of a shaft portion 2*j* of the charging roller 2. The contact portion 41*a* is formed in a wedge shape inclined with respect to the longitudinal direction X. The contact portion 41*a* is formed by an inclined (conical or frusto-conical) surface which approaches the photosensitive drum 1 as it moves toward the charging roller 2. This inclined surface is inclined with respect to the axial direction of the charging roller 2. When the movable guide member 39 is moved to the charging roller 2, the shaft end portion 2*j*2 is moved (slid) while being contacted to the contact portion 41*a* in a lower right. As a result, the charging roller 2 is moved in a separation (spacing) direction (perpendicular to the axial direction of the charging roller 2) in which the charging roller 2 is separated (spaced) from the photosensitive drum 1. When the movable guide member 39 is moved in a direction opposite from the direction toward the charging roller 2, the contact portion 41*a* is moved (slid) while being contacted to the shaft end portion 2*j*2 an upper left direction. As a result, the charging roller 2 is moved in a contact direction (perpendicular to the axial direction of the charging roller 2) in which the charging roller 2 is contacted to the photosensitive drum 1.

The preventing portion 41*b* is formed by a flat surface substantially parallel to the surface of the shaft end portion 2*j*2. The preventing portion 41*b* is, in the case where the movable guide member 39 separates the charging roller 2 from the photosensitive drum 1 and is prevented from moving by the locking portion 39*d*, disposed at a position in which it opposes the shaft end portion 2*j*2. When the cartridge 7 is subjected to vibration and shock with respect to the longitudinal direction X by the transportation in the state in which the charging roller 2 is spaced from the photosensitive drum 1, by the contact between the preventing portion 41*b* and the shaft end portion 2*j*2, the movement of the charging roller 2 toward the movable guide member 39 is prevented.

Part (a) of FIG. 5 is a side view showing a state in which the charging roller 2 is contacted to the photosensitive drum 1. As shown in (b) of FIG. 5, in an image formable state in which the charging roller 2 is contacted to the photosensitive drum 1, the charging roller 2 is contacted to the photosensitive drum 1 at predetermined pressure by the urging members 46*a* and 46*b* via the bearing members 28*a* and 28*b*. From this state, the movable guide member 39 is moved in a direction indicated by an arrow F in which it approaches the charging roller 2 along the guide portion 27*d*1 and the locking portion 27*j* of the guide portion 27*d*2. Then, the contact portion 39*a* urges the shaft end portion 2*j*1 downward while urging the shaft end portion 2*j*1 in the arrow F direction, so that the shaft end portion 2*j*1 is gradually guided rightward and downward. At the same time, the shaft end portion 2*j*2 urges the contact portion 41*a* downward while urging the contact portion 41*a* in the arrow F direction, so that the shaft end portion 2*j*2 is gradually guided rightward and downward. As a result, the charging roller 2 is moved rightward and downward.

In the above-described manner, the shaft end portion 2*j*1 is moved, in the direction in which it is spaced from the photosensitive drum 1, along the wedge shape of the contact portion 39*a* while resisting the urging force of the urging member 46*a*. At the same time, the shaft end portion 2*j*2 is moved, in the direction in which it is spaced from the photosensitive drum 1, along the wedge shape of the contact portion 41*a* while resisting the urging force of the urging member 46*b*. In this process, the projection 39*d*2 of the movable guide member 39 starts to get over the locking portion 27*j* of the frame 27 while contacting the locking portion 27*j*, so that the lever 39*d*1 is bent.

Part (c) of FIG. 5 is a side view showing a state in which the charging roller 2 is spaced from the photosensitive drum 1. As shown in (c) of FIG. 5, at the separation position W in which the movable guide member 39 is moved in a predetermined amount (distance) and the charging roller 2 is spaced from the photosensitive drum 1, the contact portion 39*a* is held in the contact state with the shaft end portion 2*j*1 and the preventing portion 39*b* opposes the shaft end portion 2*j*1. Further, at this time, the contact portion 41*a* is held in the contact state with the shaft end portion 2*j*2 and the preventing portion 41*b* opposes the shaft end portion 2*j*2.

On the other hand, the lever 38*d*1 of the movable guide member 39 is released from the bent state, so that the projection 39*d*2 is engaged with the locking portion 27*j*. On the charging roller 2, the urging force toward the contact direction with the photosensitive drum 1 is exerted by the urging members 46*a* and 46*b* via the bearing members 28*a* and 28*b*. For that reason, the shaft end portion 2*j*1 is moved to an end of the wedge-shaped contact portion 41*a*, and the shaft end portion 2*j*2 is moved to an end of the wedge-shaped contact portion 41*b*. For this reason, on the movable guide member 39, a force in the arrow G direction is exerted by the wedge shape of the contact portion 39*a*. However, the projection 39*d*2 is engaged with the locking portion 27*j* and therefore the movable guide member 39 is prevented from moving in a direction indicated by an arrow G, so that the charging roller 2 is held at the separation position W in which the charging roller 2 is spaced from the photosensitive drum 1.

In this way, the charging roller 2 is moved from the contact position V, in which the charging roller 2 is contacted to the photosensitive drum 1, along the longitudinal direction X of the frame 27. Thus, the movable guide member 39 approaches the fixed guide member 41, so that the charging roller 2 is separated from the photosensitive drum 1 while being moved along the longitudinal direction X of the frame 27. Further, by the engagement of the projection 38*d*2 of the movable guide member 39 with the locking portion 27*j* of the frame 27, the movement of the movable guide member 39 is prevented, so that the charging roller 2 is held at the separation position W in which the charging roller 2 is spaced from the photosensitive drum 1. Further, when the charging roller 2 is held at the separation position W in which the charging roller 2 is spaced from the photosensitive drum 1, the shaft end portion 2*j*1 and the preventing portion 39*b* oppose each other and the shaft end portion 2*j*2 and the preventing portion 41*b* oppose each other, so that the charging roller 2 is not moved even when the force is applied in the axial direction to the charging roller 2 due to the vibration, the shock or the like during the transportation.

Part (a) of FIG. 6 is a side view showing a state in which the charging roller 2 is spaced from the photosensitive drum 1. As shown in (a) of FIG. 6, a side plate 82 on the rear side of the apparatus main assembly 100A is provided with a lock-releasing portion 83, as a lever swinging portion, which is formed so as to be projected toward the mounting portion 22 of the cartridge 7 and is configured to swing the lever 39*d*1 in contact with the lever 39*d*1. The mounting portion 22 is shown in FIG. 3 and (a) of FIG. 4. The lock-releasing portion 83 includes an inclined surface portion 83*a* and a retracted portion 83*b*. The retracted portion 83*b* is formed in such a shape that it is retracted more than the inclined surface portion 83*a* in the direction perpendicular to the shaft (axis) of the charging roller 2. When the cartridge 7 is mounted into the apparatus main assembly 100A in the state in which the movement of the movable guide member 39 is prevented, the inclined surface portion 83*a* of the lock-releasing portion 83 is configured to enter a gap between a recessed portion 27*f* of the frame 27 and the lever 39*d*1. For this reason, the lock-releasing portion 83 swings the lever 39*d*1 to release the engagement (state) between the projection 39*d*2 and the locking portion 27*j*. Then, the charging roller 2 is held at the contact position V, in which it is contacted to the photosensitive drum 1 by the urging members 46*a* and 46*b*, while moving in the axial direction.

Before the cartridge 7 is mounted into the apparatus main assembly 100A, the movable guide member 39 and the fixed guide member 41 support the shaft end portions 2*j*1 and 2*j*2 so as not to approach the photosensitive drum 1. Further, the charging roller 2 is in a non-image forming state in which it is spaced from the photosensitive drum 1 via the bearing members 28*a* and 28*b* while resisting the urging force of the urging members 46*a* and 46*b*. Further, the projection 39*d*2 of the movable guide member 39 is engaged with the locking portion 27*j* of the frame 27. Therefore, the movement of the movable guide member 39 is prevented and thus the charging roller 2 is held at the separation position W in which the charging roller 2 is spaced from the photosensitive drum 1. In this state, the portions to be guided (the upper-side portion to be guided 29, the lower-side portion to be guided 30 and the lateral-side portion to be guided 33) of the cartridge 7 are operated while being guided by the respective guiding members (the upper mounting guide 80, the lower mounting guide 81 and the auxiliary mounting guide 87) of the apparatus main assembly 100A. That is, the cartridge 7 is caused to enter the inside of the apparatus main assembly 100A along the mounting direction J1.

Part (b) of FIG. 6 is a side view showing a process in which the charging roller 2 approaches the photosensitive drum 1. As shown in (b) of FIG. 6, when the cartridge 7 enters the inside of the apparatus main assembly 100A and moves to the position in which the lever 39*d*1 receives the inclined surface portion 83*a*, the lever 39*d*1 is contacted to the lock-releasing portion 83 and is gradually bent in a direction indicated by an arrow K along the shape of the inclined surface portion 83*a* of the lock-releasing portion 83. When an amount of the bending of the lever 39*d*1 is increased and thus the engagement between the projection 39*d*2 and the locking portion 27*j* is released, the charging roller 2 is moved in the direction of the contact with the photosensitive drum 1 by the urging force of the urging members 46*a* and 46*b*. At this time, the shaft end portion 2*j*2 of the charging roller 2 is moved along the wedge shape of the contact portion 41*a*. Further, the shaft end portion 2*j*1 of the charging roller 2 urges the wedge-shaped contact portion 39*a*, so that the movable guide member 39 is moved along the longitudinal direction X of the frame 27 and at the same time the shaft end portion 2*j*1 is moved along the wedge shape of the contact portion 39*a*. As a result, the charging roller 2 is moved in the direction of the contact with the photosensitive drum 1 while being moved along the longitudinal direction X of the frame 27.

Part (c) of FIG. 6 is a side view showing the state in which the charging roller 2 is contacted to the photosensitive drum 1. As shown in (c) of FIG. 6, when the charging roller 2 is moved to the contact position V in which the charging roller 2 is contacted to the photosensitive drum 1, the movement of the charging roller 2 and the movable guide member 39 is completed. At that time, the contact between the lever 39*d*1 and the inclined surface portion 83*a* is released, and the end portion of the lever 39*d*1 opposes the retracted portion 83*b*, so that the movable guide member 39 and the lock-releasing portion 83 are not contacted to each other.

Further, the engagement between the projection 39*d*2 and the locking portion 27*j* is released and therefore the shaft end portion 2*j*2 is moved along the wedge shape of the contact portion 41*a*, so that the charging roller 2 is moved along the longitudinal direction X of the frame 27. Further, in interrelation with the movement of the charging roller 2, the movable guide member 39 is moved. The movable guide member 39 is moved along the longitudinal direction X of the frame 27 in an amount of the sum of the movement amount of the charging roller 2 and the movement amount of the shaft end portion 2*j*1 along the wedge shape of the contact portion 39*a* by the urging force of the urging member 46*a*. Thus, when the charging roller 2 is contacted to the photosensitive drum 1, the movement of the charging roller 2 and the movable guide member 39 in the longitudinal direction X is completed.

As described above, the constitution in which the movable guide member 39 was provided at one end side of the charging roller 2 and was moved in the axial direction of the charging roller 2 to realize the movement of the charging roller 2 toward and away from the photosensitive drum 1 was employed. As a result, a new mechanism is not required on the other end side of the charging roller 2, so that a simple constitution is realized. Incidentally, in Embodiment 1, the charging roller 2 is completely spaced from the photosensitive drum 1 by the movable guide member 39 and the fixed guide member 41 but in order to release pressure between the charging roller 2 and the photosensitive drum 1, a constitution in which the charging roller 2 is somewhat moved in the separation direction may also be employed. That is, the charging roller 2 may also be configured so that it can be moved to a position (second position), in which the charging roller 2 is away from the photosensitive drum 1, which is remoter from the photosensitive drum 1 than the position (first position) in which the charging roller 2 is contacted to the photosensitive drum 1. For example, during non-image formation when the image formation is not effected, the movable guide member 39 is moved toward the charging roller 39 to place the charging roller 2 and the photosensitive drum 1 in a pressure-released state therebetween. Further, during the image formation (during development), the movable guide member 39 may be configured to determine the position of the charging roller 2 relative to the photosensitive drum 1 with respect to the contact and separation direction by the movable guide member 39 so that the movable guide member 39 is moved toward the separation side from the charging roller 2 so as to place the charging roller 2 in the contact state in which the charging roller 2 can perform its function. In this case, the relative position is irrelevant to whether or not the charging roller 2 is completely separated from the photosensitive drum 1.

In Embodiment 1, the cartridge 7 is configured so that the charging roller 2 can be kept in the state of separation from the develop 1 outside the apparatus main assembly 100A by providing the movable guide member 39 with the looking portion 39*d*. Further, the apparatus main assembly 100A is provided with the lock-releasing portion 83 to release the lock in interrelation with the mounting operation of the cartridge 7, so that the user is not required to remove the separation member or the like for the charging roller 2 before use of the cartridge 7. Therefore, load of the user is alleviated during exchange of the cartridge 7.

Embodiment 2

Part (a) of FIG. 7 is a side view showing a positional relation among the movable guide member 39, the fixed guide member 141, the charging roller 2 and the photosensitive drum 1 which are provided in a process cartridge and an apparatus main assembly in Embodiment 2. In this embodiment, with respect to the same constitution and effect as those in Embodiment 1, the description will be appropriately omitted by using the same reference numerals or symbols. Also in Embodiment 2, the present invention is applicable to an image forming apparatus similar to that in Embodiment 1 and therefore the description of the image forming apparatus will be omitted. A difference in constitution of Embodiment 2 from Embodiment 1 is that a different constitution of a movable guide member 139 and a different constitution of the mechanism for driving the movable guide member 139 are employed. That is, the constitution in Embodiment 2 is characterized by the constitutions of the movable guide member 139 and a locking mechanism 140. Incidentally, a fixed guide member 141 has the same constitution as that of the fixed guide member 41.

As shown in (a) of FIG. 7, a frame 127 as the cleaning frame is provided with the movable guide member on one side thereof with respect to the longitudinal direction X. The movable guide member 139 is supported movably along the longitudinal direction X by the frame 127 also as a cartridge frame. The movable guide member 139 includes a contact portion 139*a*, a preventing portion 139*b*, portions to be guided 139*a*1 and 139*a*2 and a portion to be urged 139*e*. With respect to the movable guide member 139, the portions to be guided 139*c*1 and 139*c*2 are supported movably in a direction indicated by an arrow E along the longitudinal direction X of the frame 127 by guide portions 127*d*1 and 127*d*2, respectively. Incidentally, on the other end side of the frame 127 with respect to the longitudinal direction X, the fixed guide member 141 which is formed integrally with the frame 127 is provided.

The contact portion 139*a* is disposed in a state in which a gap in a predetermined dimension is provided between itself and the photosensitive drum 1. This gap is ensured and even when the movable guide member 139 is moved, the movable guide member 139 is not contacted to the photosensitive drum 1 and thus the surface of the photosensitive drum 1 is not damaged. Further, the contact portion 139*a* is disposed at the opposing portion in which the movable guide member 139 opposes the shaft end portion 2*j*1 of a shaft portion 2*j* of the charging roller 2. The contact portion 139*a* is formed in a wedge shape inclined with respect to the longitudinal direction X. The contact portion 139*a* is formed by an inclined surface which approaches the photosensitive drum 1 as it moves toward the charging roller 2. This inclined surface is inclined with respect to the axial direction of the charging roller 2. When the movable guide member 139 is moved toward the charging roller 2, the contact portion 139*a* is moved (slid) while being contacted to the shaft end portion 2*j*1 in the axial direction. As a result, the charging roller 2 is moved in a separation (spacing) direction (perpendicular to the axial direction of the charging roller 2) in which the charging roller 2 is separated (spaced) from the photosensitive drum 1. When the movable guide member 139 is moved in a direction opposite from the direction toward the charging roller 2, the shaft end portion 2*j*1 is moved (slid) while being contacted to the contact portion 139*a* in the axial direction. As a result, the charging roller 2 is moved in a contact direction (perpendicular to the axial direction of the charging roller 2) in which the charging roller 2 is contacted to the photosensitive drum 1.

The locking mechanism 140 as a moving mechanism is attached to the frame 127 as the cartridge frame and permits movement of the movable guide member 139 in the axial direction of the charging roller 2. Hereinbelow, a detail constitution will be described. The locking mechanism 140 is disposed outside the preventing portion 139*b* of the movable guide member 139. The locking mechanism 140 includes a supporting shaft 140*c* supported by the frame 127, a cam 140*b* as a cam portion integrally rotatable about the supporting shaft 140*c*, and a lever 140*a* as a lever portion. The supporting shaft 140*c* is supported rotatably by a supporting hole (not shown) provided in the cleaning frame (frame 127). The cam 140*b* and the lever 140*a* are extended outward from the supporting shaft 140*c*, and a predetermined angle is formed between the cam 140*b* and the lever 140*a*. Then, when the lever 140*a* is rotated and the cam 140*b* urges the movable guide member 139, the movement of the movable guide member 39 is prevented and the charging roller 2 is held at a separation (spacing) position W in which the charging roller 2 is separated (spaced) from the photosensitive drum 1.

The cam 140*b* includes a first edge portion 140*b*1 and a second edge portion b2 ((b) and (c) of FIG. 7). When the control member 140 is rotated in the counterclockwise direction, the first edge portion 140*b*1 is contacted to a portion to be urged 139*e* of the movable guide member 139 ((a) and (b) of FIG. 7) and moves the movable guide member 139 in the arrow E direction, so that the charging roller 2 is separated from the photosensitive drum 1. Then, in a state in which the charging roller 2 is completely spaced from the photosensitive drum 1, the second edge portion 140*b*2 is contacted to the portion to be urged 139*e* of the movable guide member 139 ((c) of FIG. 7). Thus, the movement of the movable guide member 139 in the longitudinal direction X, so that the separation state between the charging roller 2 and the photosensitive drum 1 is held.

The preventing portion 139*b* is formed by a flat surface substantially parallel to the surface of the shaft end portion 2*j*1. The preventing portion 139*b* is, in a state in which the movable guide member 139 separates the charging roller 2 from the photosensitive drum 1 and is prevented from moving by the locking mechanism 140, provided at a position in which the preventing portion 139*b* and the shaft end portion 2*j*1 oppose each other. When the cartridge 7 is subjected to vibration and shock with respect to the longitudinal direction X by the transportation in the state in which the charging roller 2 is spaced from the photosensitive drum 1, by the contact between the preventing portion 139*b* and the shaft end portion 2*j*1, the movement of the charging roller 2 toward the movable guide member 139 is prevented.

Next, the fixed guide member 141 includes a contact portion 141*a* and a preventing portion 141*b* and is, similarly as in the case of the movable guide member 139, in a state in which a gap in a predetermined dimension is provided between itself and the photosensitive drum 1. This gap is ensured to prevent, the fixed guide member 141 from being contacted to the photosensitive drum 1 and thus the surface of the photosensitive drum 1 is not damaged. Further, the contact portion 141*a* is disposed at the opposing portion in which the fixed guide member 141 opposes the shaft end portion 2*j*2 of a shaft portion 2*j* of the charging roller 2. The contact portion 141*a* is formed in a wedge shape inclined with respect to the longitudinal direction X. The contact portion 141*a* is formed by an inclined surface which approaches the photosensitive drum 1 as it moves toward the charging roller 2. This inclined surface is inclined with respect to the axial direction of the charging roller 2. When the movable guide member 139 is moved toward the charging roller 2, the shaft end portion 2*j*2 is moved (slid) while being contacted to the contact portion 141*a* in the axial direction. As a result, the charging roller 2 is moved in a separation (spacing) direction (perpendicular to the axial direction of the charging roller 2) in which the charging roller 2 is separated (spaced) from the photosensitive drum 1. When the movable guide member 139 is moved in a direction opposite from the direction toward the charging roller 2, the contact portion 141*a* is moved (slid) while being contacted to the shaft end portion 2*j*2 the axial direction. As a result, the charging roller 2 is moved in a contact and separation direction (perpendicular to the axial direction of the charging roller 2) in which the charging roller 2 is contacted to and away from the photosensitive drum 1.

The preventing portion 141*b* is formed by a flat surface substantially parallel to the surface of the shaft end portion 2*j*2. The preventing portion 141*b* is, in the case where the movable guide member 139 separates the charging roller 2 from the photosensitive drum 1 and is prevented from moving by the locking portion 139*d*, disposed at a position in which it opposes the shaft end portion 2*j*2. When the cartridge 7 is subjected to vibration and shock with respect to the longitudinal direction X by the transportation in the state in which the charging roller 2 is spaced from the photosensitive drum 1, by the contact between the preventing portion 141*b* and the shaft end portion 2*j*2, the movement of the charging roller 2 toward the movable guide member 139 is prevented.

Part (a) of FIG. 7 is a side view showing a state in which the charging roller 2 is contacted to the photosensitive drum 1. As shown in (b) of FIG. 7, in an image formable state in which the charging roller 2 is contacted to the photosensitive drum 1, the charging roller 2 is contacted to the photosensitive drum 1 at predetermined pressure by the urging members 46*a* and 46*b* via the bearing members 28*a* and 28*b*. From this state, when the locking mechanism 140 is rotated in a direction indicated by an arrow L, the first edge portion 140*b*1 of the cam 140*b* urges the portion to be urged 139*e*. Then, the movable guide member 139 is moved in a direction indicated by an arrow F in which it approaches the charging roller 2 along the guide portion 127*d*1 and the guide portion 127*d*2. Then, the contact portion 139*a* urges the shaft end portion 2*j*1 downward while urging the shaft end portion 2*j*1 in the arrow F direction, so that the shaft end portion 2*j*1 is gradually moved rightward and downward. At the same time, the shaft end portion 2*j*2 urges the contact portion 41*a* downward while urging the contact portion 41*a* in the arrow F direction, so that the shaft end portion 2*j*2 is gradually moved rightward and downward. As a result, the charging roller 2 is moved rightward and downward.

Further, the locking mechanism 140 is rotated, so that the movable guide member 139 is moved. As a result, in interrelation with the movement of the charging roller 2 in the arrow F direction, the shaft end portion 2*j*1 is moved toward the direction of separation from the photosensitive drum 1 along the wedge shape of the contact portion 139*b* on one end side of the charging roller 2 while resisting the urging force of the urging member 46*a*. Further, similarly, the shaft end portion 2*j*2 is moved toward the direction of separation from the photosensitive drum 1 along the wedge shape of the contact portion 141*a* on the other end side of the charging roller 2 while resisting the urging force of the urging member 46*b*.

Part (c) of FIG. 7 is a side view showing a state in which the charging roller 2 is spaced from the photosensitive drum 1. As shown in (c) of FIG. 7, at the separation position W in which the movable guide member 139 is moved in a predetermined amount (distance) and the charging roller 2 is spaced from the photosensitive drum 1, the contact portion 139*a* is held in the contact state with the shaft end portion 2*j*1 and the preventing portion 39*b* opposes the shaft end portion 2*j*1. Further, at this time, the contact portion 41*a* is held in the contact state with the shaft end portion 2*j*2 and the preventing portion 41*b* opposes the shaft end portion 2*j*2.

On the charging roller 2, the urging force toward the contact direction with the photosensitive drum 1 is exerted by the urging members 46*a* and 46*b* via the bearing members 28*a* and 28*b* so as to move the shaft end portion 2*j*1 and the shaft end portion 2*j*2 is moved along the wedge shape of the contact portion 141*a* and the wedge shape of the contact portion 141*b*, respectively. For this reason, on the movable guide member 139, a force in the arrow G direction is exerted by the wedge shape of the contact portion 139*a*, so that the force in the arrow G direction is also exerted on the cam 140*b* via the portion to be urged 139*e*. However, the direction of the force is directed toward the locking mechanism 140 and thus the locking mechanism 140 is not rotated, and therefore the movable guide member 139 is prevented from moving in a direction indicated by an arrow G, so that the charging roller 2 is held at the separation position W in which the charging roller 2 is spaced from the photosensitive drum 1.

From the state in which the charging roller 2 is contacted to the photosensitive drum 1 described above, the locking mechanism 140 is rotated to move the movable guide member 139 along the longitudinal direction X of the frame 127. Thus, by the movable guide member 139 and the fixed guide member 141, the charging roller 2 is separated from the photosensitive drum 1 while being moved along the longitudinal direction X of the frame 127. Then, even when the urging force of the urging member 46 is exerted in the cam 140*b* of the locking mechanism 140 via the movable guide member 139, a force in the rotational direction is not generated in the locking mechanism 140. Therefore, by the locking mechanism 140, the movement of the movable guide member 139 is prevented, so that the state in which the charging roller 2 is spaced from the photosensitive drum 1 is kept. Further, in the state in which the charging roller 2 is spaced from the photosensitive drum 1, the shaft end portion 2*j*1 and the preventing portion 139*b* oppose each other and the shaft end portion 2*j*2 and the preventing portion 141*b* oppose each other, so that the charging roller 2 is not moved even when the force is applied in the axial direction to the charging roller 2 due to the vibration, the shock or the like during the transportation. Thus, when the cartridge 7 is demounted from the apparatus main assembly 100A in the state in which the charging roller 2 is contacted to the photosensitive drum 1, the lever 140*a* is contacted to the apparatus main assembly 100A to be rotated. Then, the charging roller 2 is held at the separation position W in which it is spaced from the photosensitive drum 1 against the urging force of the urging member 46 while moving in the axial direction. Next, an operation for contacting the charging roller 2 to the photosensitive drum 1 will be described.

As shown in (c) of FIG. 7, by the movable guide member 139 and the fixed guide member 141, the charging roller 2 is in the non-image formation state in which it is spaced from the photosensitive drum 1 against the urging member of the urging members 46*a* and 46*b* via the bearing members 28*a* and 28*b*. Further, by the locking mechanism 140, the movement of the movable guide member 139 is prevented and therefore the charging roller 2 is kept in the state in which it is spaced from the photosensitive drum 1. From this state, when the locking mechanism 140 is rotated in the direction indicated by an arrow M, the urging of the portion to be urged 139*e* by the cam 140*b* is started to be released. At that time, together with the movement of the movable guide member 139 in the arrow G direction along the guide portions 127*d*1 and 127*d*2, the shaft end portion 2*j*1 is moved along the wedge shape of the contact portion 139*a* by the urging force of the urging members 46*a* and 46*b*. Further, the shaft end portion 2*j*2 is moved along the wedge shape of the contact portion 141*a*. As a result, the charging roller 2 is contacted to the photosensitive drum 1 while moving along the longitudinal direction X of the frame 127.

When the locking mechanism 140 is rotated to the position shown in FIG. 7(*b*), the urging of the portion to be urged 139*e* by the second edge portion 130*b*2 of the cam 140*b* is completely released and at the same time, the movement of the movable guide member 139 and the charging roller 2 along the longitudinal direction X of the frame 127 has been completed. At that time, the charging roller 2 is contacted to the photosensitive drum 1 at the predetermined pressure by the urging force of the urging members 46*a* and 46*b*.

In this way, when the cartridge 7 is mounted in the apparatus main assembly 100A in the state in which the movement of the movable guide member 139 is prevented, the apparatus main assembly 100A is contacted to the lever 140*a* and thus the second edge portion 140*b*2 of the cam 140*b* release the urging toward the portion to be urged 139*e* by the movable guide member 139. Then, the charging roller 2 is held at the contact portion V, in which it is contacted to the photosensitive drum 1, by the urging force of the urging member 46 while moving in the axial direction.

FIG. 8 is an enlarged side view showing structures of the charging roller 2, the movable guide member 139, the locking mechanism 140 and a contact and separation control member 142 and is consisting of (a), (b) and (c) of FIG. 8. A constitution of the rotation of the locking mechanism 140 in interrelation with the mounting and demounting of the cartridge 7 will be described while referring to (a), (b) and (c) of FIG. 8. As shown in (a) of FIG. 8, on the rear side of the mounting portion 22, the contact and separation control member 143 is formed integrally with the upper mounting guide 80. The contact and separation control member 142 includes a groove 142*a* formed by a mounting-side guide portion 142*a*1 and a demounting-side guide portion 142*a*2. On the other hand, the frame 127 (indicated by a chain double-dashed line) is provided with an arcuate opening 127*g* from which the lever 140*a* of the locking mechanism 140 is projected. Then, the mounting operation of the cartridge 7 will be described.

As shown in (b) of FIG. 8, the lever 140*a* is guided along the mounting-side guide portion 142*a*1 depending on the amount of the movement of the cartridge 7, thus being rotated in the direction indicated by an arrow P. When the lever 140*a* is rotated in the arrow P direction, as described above, the urging of the movable guide member 139 by the locking mechanism 140 is gradually released and therefore the charging roller 2 is moved toward the side of the contact with the photosensitive drum 1 depending on the movement amount of the cartridge 8.

As shown in (c) of FIG. 8, in the state in which the mounting of the cartridge into the apparatus main assembly 100A is completed, the rotation of the lever 140*a* is ended, so that the charging roller 2 is placed in the state in which it is contacted to the photosensitive drum 1 at the predetermined pressure. In the case where the cartridge 7 is demounted from the apparatus main assembly 100A, the cartridge 7 is operated in the reverse order. The reverse order will be described below.

As shown in (c) of FIG. 8, the cartridge 7 is moved in the direction indicated by an arrow Q in the state in which the upper-side portion to be guided 29 is engaged with the upper mounting guide 80, thus being demounted from the apparatus main assembly 100A. In this state, the charging roller 2 is contacted to the photosensitive drum 1.

As shown in (b) of FIG. 8, when the cartridge 7 is demounted from the apparatus main assembly 100A, the lever 140*a* of the locking mechanism 140 is engaged with the groove 142*a*. The lever 140*a* is guided along the demounting-side guide portion 142*a*2 depending on the movement amount of the cartridge 7. When the lever 142*a*2 is rotated in the direction indicated by an arrow R, as described above, the movable guide member 139 is urged by the locking mechanism 140 and therefore the charging roller 2 is moved toward the side of separation from the photosensitive drum 1 depending on the movement amount of the cartridge 7.

As shown in (a) of FIG. 8, when the cartridge 7 is further demounted from the apparatus main assembly 100A, the rotation of the lever 140*a* is ended, so that the charging roller 2 is placed in the state of separation from the photosensitive drum 1.

In Embodiment 2, the apparatus main assembly 100A is provided with the groove 142*a*, and the charging roller 2 is constituted to the photosensitive drum 1 in interrelation with the mounting operation of the cartridge 7. Further, the cartridge 2 is spaced from the photosensitive drum 1 in interrelation with the demounting operation of the cartridge 7 and outside the apparatus main assembly 100A, the cartridge 7 is configured so that the charging roller 2 can be kept in the state of separation from the photosensitive drum 1. Therefore, before the use of the cartridge 7, the user is not required to remove the spacing member for the charging roller 2, so that the load on the user is alleviated during the exchange of the cartridge 7. Further, after the use of the cartridge 7, the user is not required to attach the spacing member to the charging roller 2 and therefore permanent deformation is not caused to occur at the surface of the charging roller 2 after the use. For this reason, even when an inexpensive material is used, at the time of reuse of the removed charging roller 2, an efficiency percentage of the recycled material is improved.

Further, in Embodiment 2, the guide portion of the apparatus main assembly 100A is provided with the contact and separation control member 142. As a result, in interrelation with the mounting operation of the cartridge 7 by the user, the charging roller 2 is contacted to the photosensitive drum 1. Further, in interrelation with the demounting operation of the cartridge 7, the charging roller 2 is spaced from the photosensitive drum 1. However, the charging roller 2 may also be contacted to the photosensitive drum 1 by rotating the lever 140*a* before the user of the cartridge 7 by the user himself (herself) without providing the contact and separation control member 142 in the apparatus main assembly 100A. Further, the charging roller 2 may also be spaced from the photosensitive drum 1 by rotating the lever 140*a* after the use of the cartridge 7 by the user himself (herself). Further, it is also possible to employ a constitution in which the contact and separation state between the charging roller 2 and the photosensitive drum 1 is operated by the user himself (herself).

Further, in Embodiment 2, at the separation position of the charging roller 2 relative to the photosensitive drum 1, the edge portion 140*b*2 was rotated 90 degrees to be placed in the state of contact with the portion to be urged 139*e*, and the locking mechanism 140 was configured not to be rotated both in the arrow L direction and the arrow M direction (FIG. 8). However, the present invention may also be not limited to this embodiment. That is, in the case as in FIG. 8, the locking mechanism 140 may also be configured so that it can be further rotated in the arrow L direction even after it is rotated 90 degrees or more (e.g., 100 degrees) and is stopped. In such a constitution, when the locking mechanism 140 is rotated at an angle exceeding the angle at which the charging roller 2 can be spaced from the photosensitive drum 1, the separation state of the charging roller 2 from the photosensitive drum 1 is maintained.

Incidentally, also in Embodiment 2, similarly as described in Embodiment 1, it is also possible to employ the constitution in which the charging roller 2 is not completely spaced from the photosensitive drum 1 but may be moved somewhat in the separation direction in order to release the pressure between the charging roller 2 and the photosensitive drum 1. That is, the charging roller 2 may also be configured to be movable to the position (second position) in which the charging roller 2 is moved in the direction of separation from the photosensitive drum 1 more than the position (first position) in which the charging roller 2 is contacted to the photosensitive drum 1.

According to the cartridges and the image forming apparatuses in Embodiments 1 and 2, when the movable guide members 39 and 139 provided at the one side of the charging roller 2 act on the shaft end portion 2*j*1, the charging roller 2 is contacted to and away from the photosensitive drum 1. Therefore, by the movable guide members 39 and 139 each of which is a single movable member, both of the shaft end portions 2*j*1 and 2*j*2 of the charging roller 2 are moved. Then, in the case where the cartridge 7 is demounted from the apparatus main assembly 100A, the charging roller 2 is moved in the direction of separation from the photosensitive drum 1 in interrelation with the demounting operation, so that the photosensitive drum 1 and the charging roller 2 are moved from their contact state to their separation state. Further, in the case where the cartridge 7 is mounted into the apparatus main assembly 100A, the charging roller 2 is moved in the direction of contact with the photosensitive drum 1 in interrelation with the mounting operation, so that the photosensitive drum 1 and the charging roller 2 are moved from their separation state to their contact state. As a result, the labor or driving force required for the separation of the charging roller 2 from the photosensitive drum 1 is reduced. In other words, without causing upsizing of the apparatus main assembly 100A, the charging roller 2 can be moved toward and away from the photosensitive drum 1 with a simple constitution and with no increase in load on the user.

Further, during the transportation (in the unused state, particularly during conveyance) of the cartridge 7, the movement of the movable guide members 39 and 139 is prevented by the projection 39*d*2 and the locking portion 27*j* or by the second edge portion 140*b*2 and the portion to be urged 139*e*, so that the state of separation of the charging roller 2 from the photosensitive drum 1 is kept. Therefore, even in the case where the charging roller 2 formed of the inexpensive material is used, the permanent deformation did not occur at the surface of the charging roller 2. As a result, the image defect such as the density non-uniformity is prevented.

Further, the charging roller 2 is moved toward and away from the photosensitive drum 1 in the state in which the movable guide members 39 and 139 are not contacted to the photosensitive drum 1. As a result, the contact and separation of the charging roller 2 can be realized, even when complicated circuit and mechanism are not provided, without damaging the photosensitive drum 1.

Further, the apparatus main assembly 100A is provided with the lock-releasing portion 83 or the contact and separation control member 142 and therefore when the cartridge 7 is mounted into the apparatus main assembly 100A, the charging roller 2 is disposed at the contact position in which it is contacted to the photosensitive drum 1 by the mechanism of the cartridge 7 and the image forming apparatus 100.

Incidentally, in Embodiments 1 and 2, the contact portion 39*a* (139*a*) and the contact portion 41*a* (141*a*) were formed by the inclined surface which approached the photosensitive drum 1 with the decreasing distance toward the charging roller 2 but the present invention may also be not limited to this embodiment (constitution). For example, it is also possible to employ a constitution in which the shaft end portions 2*j*1 and 2*j*2 are provided with a tapered portion (inclined surface) and in which the contact portion 39*a* is formed by a flat surface to be contacted to the shaft end portion 2*j*1 and the contact portion 41*a* is formed by a flat surface to be contacted to the shaft end portion 2*j*2. In this case, the contact portion 39*a* and the contact portion 41*a* may preferably be set in size such that they are contacted to only the tapered portion. In addition, the contact portion 39*a* and the shaft end portion 2*j*2 may also be configured to have the tapered portion (inclined surface) or the contact portion 41*a* and the shaft end portion 2*j*1 may also be configured to have the tapered portion (inclined surface).

That is, at least one of the first contact portion and the first shaft end portion is configured to have the inclined surface inclined with respect to the axial direction of the charging roller 2. And, at least one of the second contact portion and the second shaft end portion is configured to have the inclined surface inclined with respect to the axial direction of the charging roller 2. Further, when the movable guide member 39 (139) is moved in the axial direction of the charging roller 2, the charging roller 2 may be configured by the above-described tapered portion so that the charging roller 2 is moved to the separation position against the urging force of the urging member while moving in the axial direction. Further, in these cases, the "inclined surface" may be formed to have an entire flat surface or may also be formed to have one or a plurality of stepped portions.

Incidentally, in Embodiments 1 and 2 described above, the electrophotographic image forming apparatus was described as the example of the image forming apparatus. The image forming type of the image forming apparatus is not limited to the electrophotographic image forming type in Embodiments 1 and 2. The image forming type may also be an electrostatic recording type in which an electrostatic recording dielectric member is used as the image bearing member or a magnetic recording type in which a magnetic recording member is used as the image bearing member.

Further, in Embodiments 1 and 2 described above, as the rotatable roller to be contacted to the photosensitive drum 1, the charging roller 2 was described as the example but the rotatable roller is not limited thereto. For example, the developing roller 25 may also be used as the mechanism to be moved to the position of contact with the photosensitive drum 1 and the position of separation from the photosensitive drum 1.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 059088/2010 filed Mar. 16, 2010 and 046024/2011 filed Mar. 3, 2011, which are hereby incorporated by reference.

What is claimed is:

1. A process cartridge detachably mountable to a main assembly of an image forming apparatus, comprising:

an image bearing member capable of bearing a toner image;

a rotatable roller rotatable in contact with said image bearing member;

a bearing member for rotatably supporting ends of a shaft of said rotatable roller;

urging means for urging said rotatable roller via said bearing member in a direction in which said rotatable roller is contacted to said image bearing member;

a cartridge frame for rotatably supporting said image bearing member and for movably holding said rotatable roller via said bearing member in a contact and separation direction in which said rotatable roller is contacted to and separated from said image bearing member;

a movable guide member which is supported, by said cartridge frame, movably in an axial direction of the shaft of said rotatable roller and which is provided at one end side of said rotatable roller, said movable guide member including a first contact portion at an opposing position in which it opposes a first shaft end portion of said rotatable roller; and a fixed guide member which is fixed to said cartridge frame and which is provided at the other end side of said rotatable roller, said fixed guide member including a second contact portion at an opposing position in which it opposes a second shaft end portion of said rotatable roller, wherein at least one of the first contact portion and the first shaft end portion has an inclined surface inclined with respect to the axial direction of said rotatable roller, and at least one of the second contact portion and the second shaft end portion has an inclined surface inclined with respect to the axial direction of said rotatable roller.

2. A process cartridge according to claim 1, wherein said movable guide member includes a lever portion provided with an engaging portion for being engaged with said cartridge frame, wherein said cartridge frame includes a portion to be engaged with which the engaging portion is to be engaged, and wherein when said movable guide member is moved and the engaging portion is engaged with the portion to be engaged, movement of said movable guide member is presented and said rotatable roller is held at the second position.

3. A process cartridge according to claim 2, wherein the main assembly of the image forming apparatus includes a lever swinging portion for swing the lever portion in contact with the lever portion, and wherein when said process cartridge is mounted in the main assembly in a state in which the movement of said movable guide member is presented, the lever swinging portion swings the lever portion to release an engaging state between the engaging portion and the portion to be engaged and said rotatable roller is held at the first position.

4. A process cartridge according to claim 1, further comprising a movable mechanism, mounted to said cartridge frame, capable of moving said movable guide member in the axial direction of said rotatable roller, wherein said movable mechanism includes a supporting shaft supported by said cartridge frame and includes a cam portion and a lever portion which are integrally rotatable about the supporting shaft, and wherein when the lever portion is rotated and the cam portion urges said movable guide member, movement of said movable guide member is presented and said rotatable roller is held at the second position.

5. A process cartridge according to claim 4, wherein when said process cartridge is mounted in the main assembly of the image forming apparatus in a state in which the movement of said movable guide member is presented, the main assembly is contacted to the lever portion and the cam portion releases urging toward said movable guide member, and said rotatable roller is held at the first position.

6. A process cartridge according to claim 4, wherein when said process cartridge is demounted from the main assembly of the image forming apparatus in a state in which said rotatable roller is contacted to said image bearing member, the lever portion is contacted to the main assembly to be rotated, and by the rotation of the lever portion, the cam portion urges said movable guide member to present the movement of said movable guide member and said rotatable roller is held at the second position.

7. A process cartridge according to claim 1, wherein said rotatable roller is a charging roller for electrically charging said image bearing member.

8. A process cartridge according to claim 1, wherein said rotatable roller is a developing roller for forming a toner image on said image bearing member.

9. A process cartridge according to claim 1, wherein said rotatable roller is movable to a first position in which it is contacted to said image bearing member and a second position in which it is away from said image bearing member, and wherein by movement of said movable guide member in the axial direction of said rotatable roller, the first shaft end portion is moved in contact with the first contact portion and the second shaft end portion is moved in contact with the second contact portion so that said rotatable roller is moved from the first position to the second position against an urging force of said urging member while being moved in the axial direction.

10. An image forming apparatus including a main assembly to which a process cartridge is detachably mountable, comprising:

a mounting portion for mounting and demounting said process cartridge; and said process cartridge, comprising:

an image bearing member capable of bearing a toner image;

a rotatable roller rotatable in contact with said image bearing member;

a bearing member for rotatably supporting ends of a shaft of said rotatable roller;

urging means for urging said rotatable roller via said bearing member in a direction in which said rotatable roller is contacted to said image bearing member;

a cartridge frame for rotatably supporting said image bearing member and for movably holding said rotatable roller via said bearing member in a contact and separation direction in which said rotatable roller is contacted to and separated from said image bearing member;

a movable guide member which is supported, by said cartridge frame, movably in an axial direction of the shaft of said rotatable roller and which is provided at one end side of said rotatable roller, said movable guide member including a first contact portion at an opposing position in which it opposes a first shaft end portion of said rotatable roller; and a fixed guide member which is fixed to said cartridge frame and which is provided at the other end side of said rotatable roller, said fixed guide member including a second contact portion at an opposing position in which it opposes a second shaft end portion of said rotatable roller, wherein at least one of the first contact portion and the first shaft end portion has an inclined surface inclined with respect to the axial direction of said rotatable roller, and at least one of the second contact portion and the second shaft end portion has an inclined surface inclined with respect to the axial direction of said rotatable roller.

11. An image forming apparatus cartridge according to claim 10, wherein said movable guide member includes a lever portion provided with an engaging portion for being engaged with said cartridge frame, wherein said cartridge frame includes a portion to be engaged with which the engaging portion is to be engaged, and wherein when said movable guide member is moved and the engaging portion is engaged with the portion to be engaged, movement of said movable guide member is presented and said rotatable roller is held at the second position.

12. An image forming apparatus according to claim 11, wherein the main assembly of the image forming apparatus includes a lever swinging portion for swing the lever portion in contact with the lever portion, and wherein when said process cartridge is mounted in the main assembly in a state in which the movement of said movable guide member is presented, the lever swinging portion swings the lever portion to release an engaging state between the engaging portion and the portion to be engaged and said rotatable roller is held at the first position.

13. An image forming apparatus according to claim 10, further comprising a movable mechanism, mounted to said cartridge frame, capable of moving said movable guide member in the axial direction of said rotatable roller, wherein said movable mechanism includes a supporting shaft supported by said cartridge frame and includes a cam portion and a lever portion which are integrally rotatable about the supporting shaft, and wherein when the lever portion is rotated and the cam portion urges said movable guide member, movement of said movable guide member is presented and said rotatable roller is held at the second position.

14. An image forming apparatus according to claim 13, wherein the main assembly of said image forming apparatus includes contact and separation control member for moving said rotatable roller toward and away from said image bearing member, and wherein when said process cartridge is mounted in the main assembly of said image forming apparatus in a state in which the movement of said movable guide member is presented, said contact and separation control member is contacted to the lever portion and the cam portion releases urging toward said movable guide member, and said rotatable roller is held at the first position.

15. An image forming apparatus according to claim 13, wherein the main assembly of said image forming apparatus includes a contact and separation control member for moving said rotatable roller toward and away from said image bearing member, and wherein when said process cartridge is demounted from the main assembly of said image forming apparatus in a state in which said rotatable roller is contacted to said image bearing member, the lever portion is contacted to the said contact and separation control member to be rotated, and by the rotation of the lever portion, the cam portion urges said movable guide member to present the movement of said movable guide member and said rotatable roller is held at the second position.

16. An image forming apparatus according to claim 10, wherein said rotatable roller is a charging roller for electrically charging said image bearing member.

17. An image forming apparatus according to claim 10, wherein said rotatable roller is a developing roller for forming a toner image on said image bearing member.

18. An image forming apparatus according to claim 10, wherein said rotatable roller is movable to a first position in which it is contacted to said image bearing member and a second position in which it is away from said image bearing member, and wherein by movement of said movable guide member in the axial direction of said rotatable roller, the first shaft end portion is moved in contact with the first contact portion and the second shaft end portion is moved in contact with the second contact portion so that said rotatable roller is moved from the first position to the second position against an urging force of said urging member while being moved in the axial direction.

* * * * *